US010061258B2

(12) United States Patent
Hashimoto et al.

(10) Patent No.: US 10,061,258 B2
(45) Date of Patent: Aug. 28, 2018

(54) DRUM UNIT

(71) Applicant: Brother Kogyo Kabushiki Kaisha, Nagoya-shi, Aichi-ken (JP)

(72) Inventors: Junichi Hashimoto, Toyohashi (JP); Ryuya Yamazaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/399,129

(22) Filed: Jan. 5, 2017

(65) Prior Publication Data

US 2017/0115624 A1 Apr. 27, 2017

Related U.S. Application Data

(63) Continuation of application No. 15/222,389, filed on Jul. 28, 2016, now Pat. No. 9,581,955, which is a (Continued)

(30) Foreign Application Priority Data

Mar. 31, 2014 (JP) ..... 2014-073246

(51) Int. Cl.
*G03G 21/10* (2006.01)

(52) U.S. Cl.
CPC ..... *G03G 21/105* (2013.01); *G03G 21/10* (2013.01); *G03G 2221/0026* (2013.01)

(58) Field of Classification Search
CPC ..... G03G 21/10; G03G 21/21; G03G 21/105
See application file for complete search history.

(56) References Cited

U.S. PATENT DOCUMENTS 6,122,470 A 9/2000 Kimura
7,486,910 B2 2/2009 Kitozaki
(Continued)

FOREIGN PATENT DOCUMENTS

CN 1591227 A 3/2005
CN 102141753 A 8/2011
(Continued)

OTHER PUBLICATIONS

Oct. 7, 2015—U.S. Non-Final Office Action—U.S. Appl. No. 14/666,949.
(Continued)

*Primary Examiner* — David M Gray
*Assistant Examiner* — Andrew V Do
(74) *Attorney, Agent, or Firm* — Banner & Witcoff, Ltd.

(57) ABSTRACT

A drum unit includes a photosensitive drum, a side plate, a cleaning unit, a waste-toner conveyor unit. The photosensitive drum has a first drum body and a second drum body, each having a photosensitive layer and a supported portion extending from one end of the drum body in a first direction along a rotational axis of the photosensitive drum. The side plate supports the supported portions. The cleaning unit has cleaners and conveyors corresponding to the drum bodies so as to remove waste toner from the photosensitive drums and convey the waste toner removed by the cleaners in the first direction. The waste-toner conveyor unit has a collecting conveyor configured to convey the waste toner conveyed by the. The collecting conveyor is disposed between the side plate and the drum bodies. The collecting conveyor is disposed below the first conveyor.

20 Claims, 14 Drawing Sheets

Related U.S. Application Data continuation of application No. 14/666,949, filed on Mar. 24, 2015, now Pat. No. 9,417,596.

(56) References Cited

U.S. PATENT DOCUMENTS

| | | | | |
|---|---|---|---|---|
| 8,116,662 | B2 | 2/2012 | Ohta | |
| 8,380,117 | B2 | 2/2013 | Ohta | |
| 8,583,023 | B2 | 11/2013 | Yuasa | |
| 2003/0156848 | A1 | 8/2003 | Kawai et al. | |
| 2004/0161261 | A1 | 8/2004 | Kasahara et al. | |
| 2005/0047825 | A1 | 3/2005 | Nakano et al. | |
| 2009/0324284 | A1 | 12/2009 | Ohta | |
| 2010/0272467 | A1 | 10/2010 | Sato | |
| 2011/0044743 | A1 | 2/2011 | Yuasa | |
| 2011/0103857 | A1 | 5/2011 | Ohta | |
| 2013/0071165 | A1 | 3/2013 | Kitamura | |
| 2013/0259495 | A1 | 10/2013 | Ota | |
| 2015/0147088 | A1* | 5/2015 | Sato | G03G 21/1853 399/110 |

FOREIGN PATENT DOCUMENTS

| | | | |
|---|---|---|---|
| JP | S60-128370 | U | 8/1985 |
| JP | H02-119281 | U | 9/1990 |
| JP | H03-138660 | A | 6/1991 |
| JP | H07-301993 | A | 11/1995 |
| JP | 2000-003092 | A | 1/2000 |
| JP | 2000-221847 | A | 8/2000 |
| JP | 2003-223091 | A | 8/2003 |
| JP | 2004-070088 | A | 3/2004 |
| JP | 2005-070407 | A | 3/2005 |
| JP | 2006-293288 | A | 10/2006 |
| JP | 2009-020281 | A | 1/2009 |
| JP | 2010-008472 | A | 1/2010 |
| JP | 2010-008810 | A | 1/2010 |
| JP | 2011-043568 | A | 3/2011 |
| JP | 2011-064739 | A | 3/2011 |
| JP | 2011-095518 | A | 5/2011 |
| JP | 2011-133767 | A | 7/2011 |
| JP | 2011-154239 | A | 8/2011 |
| JP | 2011-203367 | A | 10/2011 |
| JP | 2013-064953 | A | 4/2013 |
| JP | 2013-178424 | A | 9/2013 |
| JP | 2013-205612 | A | 10/2013 |
| JP | 2014-016485 | A | 1/2014 |
| WO | 2014010115 | A1 | 1/2014 |

OTHER PUBLICATIONS

Apr. 12, 2016—U.S. Notice of Allowance—U.S. Appl. No. 14/666,949.

Dec. 6, 2016—(JP) Office Action—App 2014073246—Eng Tran.

Oct. 7, 2016—U.S. Notice of Allowance—U.S. Appl. No. 15/222,389.

* cited by examiner

DRUM UNIT

CROSS-REFERENCE TO RELATED APPLICATION

This application is a continuation of U.S. application Ser. No. 15/222,389, filed Jul. 28, 2016, which is a continuation of U.S. application Ser. No. 14/666,949, filed Mar. 24, 2015, now U.S. Pat. No. 9,417,596, which claims priority from Japanese Patent Application No. 2014-073246, filed on Mar. 31, 2014, which are incorporated herein by reference in their entirety.

TECHNICAL FIELD

Aspects disclosed herein relate to a drum unit for an electrophotographic image forming apparatus.

BACKGROUND

A known electrophotographic image forming apparatus includes a tandem-type color printer that includes a plurality of image carrying members corresponding to respective colors, for example, yellow, magenta, cyan, and black.

Such a color printer includes a plurality of process cartridges, a frame, and a waste-toner conveyor pipe. The process cartridges support photosensitive drums, respectively. The frame supports the plurality of process cartridges. The waste-toner conveyor pipe is configured to convey waste toner from the process cartridges to a waste-toner storage box.

SUMMARY

In such the printer, the waste-toner conveyor pipe may be disposed outside the process cartridges that support the photosensitive drums, respectively, while being supported by the frame.

Therefore, the frame may have a space for installing the waste-toner conveyor pipe, as well as a space for supporting the process cartridges. Thus, it may be difficult to avoid an increase in size of an image forming unit.

Accordingly, for example, aspects of the disclosure provide for a drum unit that may include a configuration that might not increase its size.

According to the aspects of the disclosure, the second conveyor member may be disposed in the space that extends between the side plate and the ends of the drum bodies in the axial direction, whereby restricting increase in size of the drum unit.

DESCRIPTION OF THE DRAWINGS

Aspects of the disclosure are illustrated by way of example and not by limitation in the accompanying figures in which like reference characters indicate similar elements.

DETAILED DESCRIPTION

For a more complete understanding of the present disclosure, needs satisfied thereby, and the objects, features, and advantages thereof, reference now is made to the following descriptions taken in connection with the accompanying drawings. Hereinafter, illustrative embodiments of the disclosure will be described in detail with reference to the accompanying drawings.

1. Overall Configuration of Printer

Figure 1:
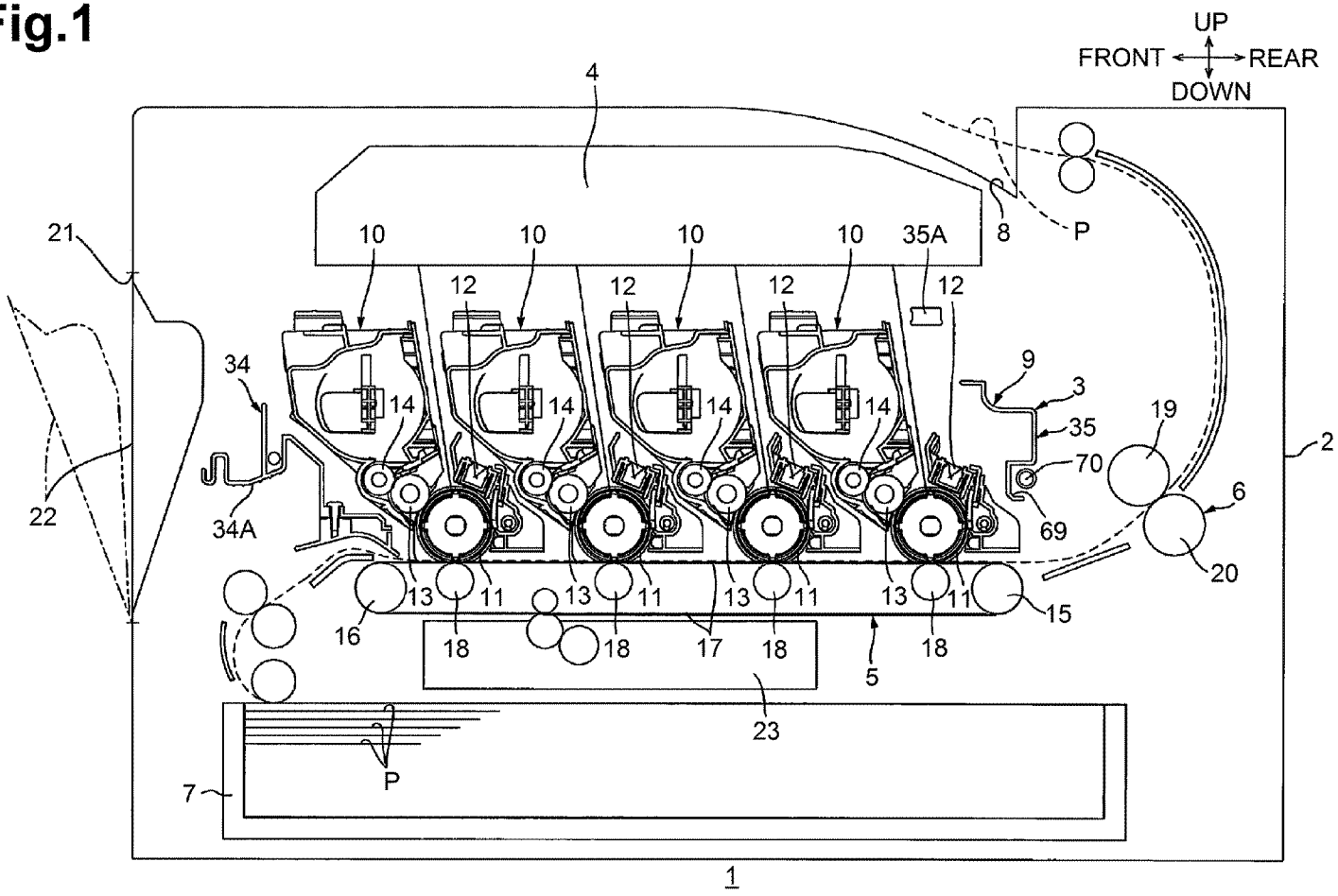
FIG. 1 is a vertical, central cross sectional view depicting a printer embodying an image forming apparatus in an illustrative embodiment according to one or more aspects of the disclosure.

As depicted in FIG. 1, a printer 1 may be a direct-tandem type color laser printer.

With reference to the printer 1, directions of up, down, right, left, front, and rear is defined with reference to an orientation of the printer 1 that is disposed in which it is intended to be used as depicted in FIG. 1.

The printer 1 includes a printer body 2, a process unit 3, a scanner unit 4, a transfer unit 5, and a fixing unit 6.

The printer body 2 has a substantially box shape. The printer body 2 has an opening 21 and includes a front cover 22, a sheet feed tray 7, and a sheet discharge tray 8.

The opening 21 is defined in a front end portion of the printer body 2. The opening 25 provides communication between the inside and the outside of the printer body 2 in a front-rear direction to allow the process unit 3 to pass therethrough.

The front cover 22 is disposed at the front end portion of the printer body 2. The front cover 22 has a substantially flat-plate shape. The front cover 22 extends in an up-down direction and is supported by a front wall of the printer body 2 so as to be pivotable on its lower end portion. The front cover 22 is configured to expose or close the opening 21.

The sheet feed tray 7 is disposed at a lower portion of the printer body 2. The sheet feed tray 7 is configured to accommodate therein one or more sheets P.

The sheet discharge tray 8 is disposed at an upper wall of the printer body 2. The sheet discharge tray 8 is recessed than an upper surface of the printer body 2 for supporting one or more sheets P thereon.

The process unit 3 is located at a substantially middle portion of the printer body 2. The process unit 3 includes a drum unit 9 and a plurality of developing cartridges 10. The process unit 3 is configured to be movable, through the opening 21, between an installed position, at which the process unit 3 is placed inside the printer body 2 and ready for use, and a pulled-out position, at which the process unit 3 is located substantially outside the printer body 2 and all of the developing cartridges 10 can be attached to or detached from the process unit 3.

The drum unit 9 includes a plurality of photosensitive drums 11 and a plurality of scorotron chargers 12.

The plurality of photosensitive drums 11 are rotatably supported at a lower end portion of the process unit 3. The plurality of photosensitive drums 11 are provided for respective toner colors, for example, yellow, magenta, cyan, and black. The plurality of photosensitive drums 11 are arranged side by side in the front-rear direction in the order of yellow, magenta, cyan, and black from the front to the rear and spaced apart from each other. Each of the plurality of photosensitive drums 11 has a substantially cylindrical shape extending in a right-left direction.

The plurality of scorotron chargers 12 are provided for the plurality of photosensitive drums 11, respectively. The plurality of scorotron chargers 12 are disposed above and behind the plurality of photosensitive drums 11, respectively, and are spaced apart from the plurality of photosensitive drums 11, respectively.

The plurality of developing cartridges 10 are provided for the plurality of photosensitive drums 11, respectively. The plurality of developing cartridges 10 are disposed above the plurality of photosensitive drums 11, respectively. Each of the plurality of developing cartridges 10 includes a developing roller 13 and a supply roller 14. Each of the plurality of developing cartridges 10 has a space for storing therein toner of one of colors, above the developing roller 13 and the supply roller 14.

In each of the developing cartridges 10, the developing roller 13 is rotatably supported at a lower end portion of one of the developing cartridges 10 and is exposed from a lower rear portion of one of the developing cartridges 10. The developing roller 13 is disposed in contact with an upper front portion of a corresponding one of the photosensitive drums 11.

In each of the developing cartridges 10, the supply roller 14 is disposed above and forward of the developing roller 13. The supply roller 14 is disposed in contact with an upper front portion of the developing roller 13.

The scanner unit 4 is disposed at an upper portion of the printer body 2. As indicated by solid lines in FIG. 1, the scanner unit 4 is configured to emit laser beams toward the photosensitive drums 11, respectively, based on image data, to expose the photosensitive drums 11 with the laser beams.

The transfer unit 5 is disposed below the process unit 3. The transfer unit 5 includes a drive roller 15, a following roller 16, a conveyor belt 17, and a plurality of transfer rollers 18.

The drive roller 15 is disposed at a rear end portion of the transfer unit 5.

The following roller 16 is disposed at a front end portion of the transfer unit 5. The following roller 16 is disposed opposite to the drive roller 15 and spaced apart from the drive roller 15.

The conveyor belt 17 is wound around the drive roller 15 and the following roller 16 such that an upper portion of the conveyor belt 17 comes into contact with all the photosensitive drums 11. The conveyor belt 17 is configured to rotate such that its upper portion moves in a front-to-rear direction with rotation the drive roller 15 and the following roller 16.

The plurality of transfer rollers 18 are provided for the plurality of photosensitive drums 11, respectively. The plurality of transfer rollers 18 are disposed below the plurality of photosensitive drums 11, respectively, while the conveyor belt 17 is interposed therebetween.

The fixing unit 6 is disposed behind the transfer unit 5. The fixing unit 6 includes a heat roller 19 and a pressure roller 20. The pressure roller 20 is disposed in contact with the heat roller 19.

As the printer 1 starts an image forming operation, the scorotron chargers 12 charge surfaces of the corresponding photosensitive drums 11 uniformly and the scanner unit 4 exposes the surfaces of the photosensitive drums 11 with laser beams. Thus, an electrostatic image based on image data is formed on the surface of each of the photosensitive drums 11.

In each developing cartridge 10, the supply roller 14 supplies toner to the developing roller 13. Meanwhile, toner is positively charged by friction caused between the developing roller 13 and the supply roller 14 and is then carried by the developing roller 13.

Thereafter, the developing roller 13 further supplies toner to the electrostatic latent image formed on the surface of the corresponding photosensitive drum 11. Thus, the electrostatic latent image becomes a toner image on the surface of the photosensitive drum 11.

One or more sheets P are fed, one by one, upwardly forward from the sheet feed tray 7 by rotation of the rollers and then a direction that a sheet P is conveyed is changed to upwardly rearward. In such a manner, the one or more sheets P are fed, one by one, to between the photosensitive drum 11 for yellow and the conveyor belt 17 at a predetermined timing. Then, the sheet P is conveyed rearward by rotation of the conveyor belt 17. The toner images held by the respective photosensitive drums 11 are transferred on the sheet P while the sheet P passes each of the photosensitive drums 11 and a corresponding one of the transfer rollers 18.

Thereafter, the sheet P is applied with heat and pressure while the sheet P passes between the heat roller 19 and the pressure roller 20, whereby the toner images transferred onto the sheet P are fixed thereon by heat. The sheet P is then discharged onto the sheet discharge tray 8.

2. Details of Drum Unit

Figure 2:
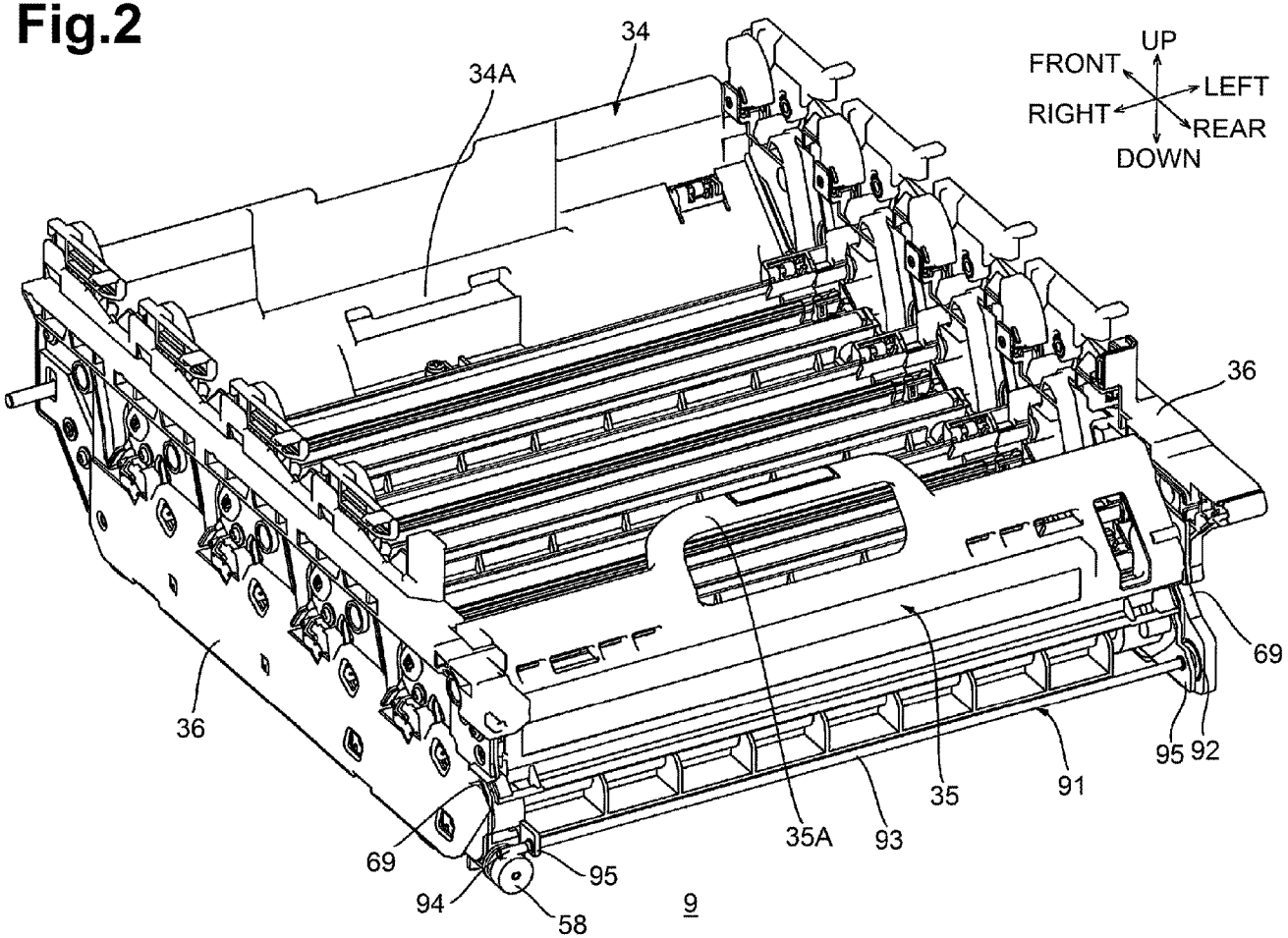
FIG. 2 is a right rear perspective view depicting the drum unit depicted in FIG. 1 in the illustrative embodiment according to one or more aspects of the disclosure.
Figure 4:
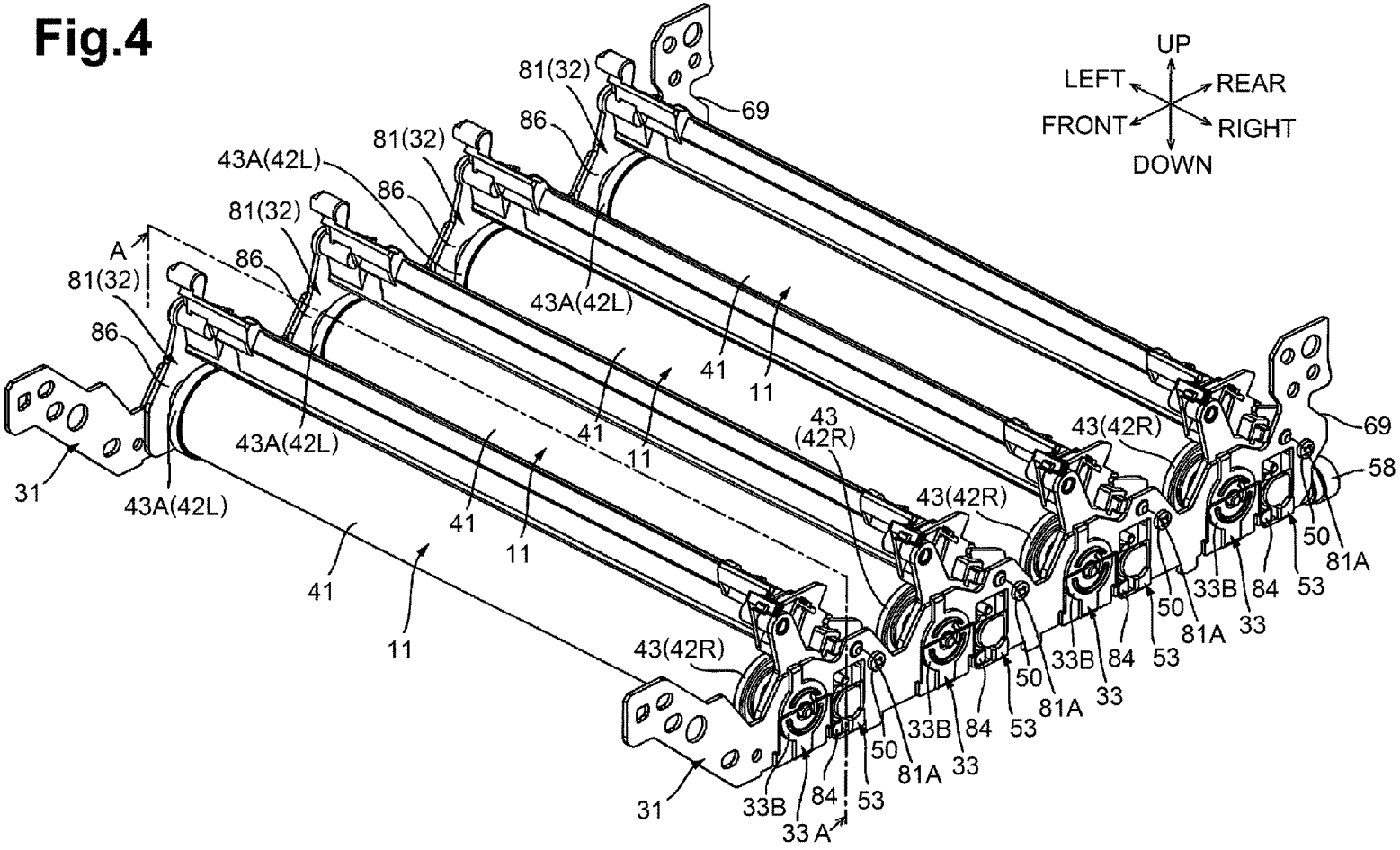
FIG. 4 is a right front perspective view depicting the drum unit depicted in FIG. 2 from which a front plate, a rear plate, and outer side-plates are removed in the illustrative embodiment according to one or more aspects of the disclosure.

As depicted in FIGS. 2 and 4, the drum unit 9 has a substantially rectangular frame shape in plan view. The drum unit 9 includes a pair of inner side-plates 31, the plurality of photosensitive drums 11, a plurality of bearing members 33, a drum cleaning unit 30 (see FIG. 5), a rotation member 91, a front plate 34, a rear plate 35, and a pair of outer side-plates 36.

(1) Inner Side-Plates

Figure 5:
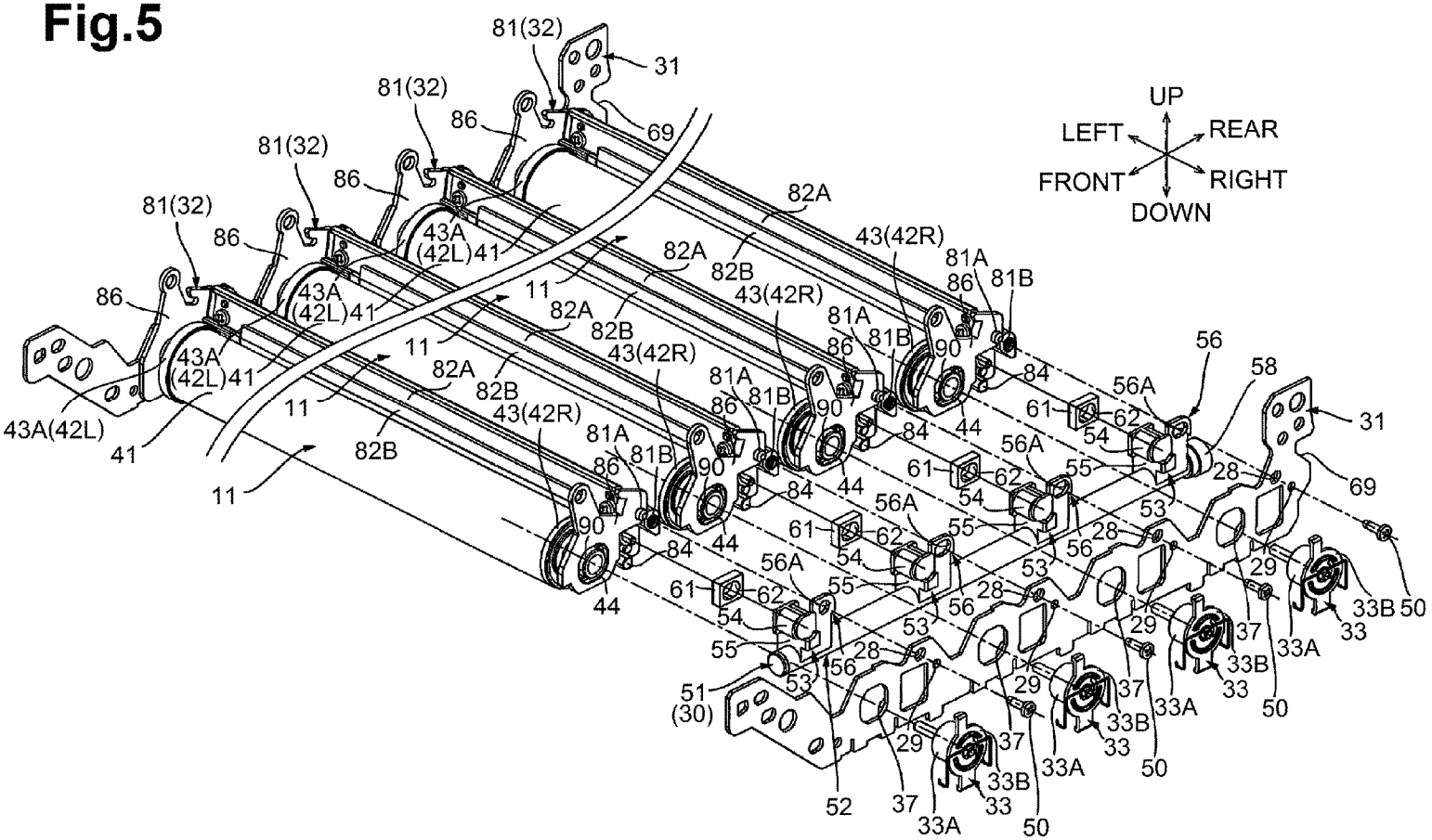
FIG. 5 is a disassembled right front perspective view depicting of the drum unit depicted in FIG. 4 in the illustrative embodiment according to one or more aspects of the disclosure.

As depicted in FIG. 4, the inner side-plates 31 are spaced apart from each other in the right-left direction and are disposed at both right and left end portions of the drum unit 9 in the right-left direction. The inner side-plates 31 each have a substantially rectangular flat-plate shape in side view and extend in the front-rear direction. The inner side-plates 31 are obtained by which metal plates are pressed using the same press die. Thus, the inner side-plates 31 are identical in shape. As depicted in FIG. 5, each of the inner side-plates 31 includes a plurality of through holes 37, a plurality of boss pass-through holes 28, a plurality of screw pass-through holes 28, and a notch 69.

The plurality of through holes 37 are spaced apart from each other at regular intervals in the front-rear direction. The plurality of through holes 37 are provided for the plurality of photosensitive drums 11, respectively, and more specifically, there are four through holes 37 defined in each of the inner side-plates 31. The plurality of through holes 37 each have a substantially circular shape in side view.

The plurality of boss pass-through holes 28 are disposed above and behind the plurality of through holes 37, respectively. The plurality of boss pass-through holes 28 penetrate the inner side-plates 31 in the right-left direction. The plurality of boss pass-through holes 28 each are elongated in the front-rear direction and have a substantially oval shape in side view.

The plurality of screw pass-through holes 28 are disposed below and behind the plurality of boss pass-through holes 28, respectively. The plurality of boss pass-through holes 28 penetrate the inner side-plates 31 in the right-left direction and have a substantially circular shape in side view.

The notch 69 is defined in a rear end portion of each of the inner side-plates 31. A portion of each of the inner side-plates 31 is cut toward the front from a rear edge thereof to provide the notch 69 in each of the inner side-plates 31. The notches 69 each have a substantially V-letter shape in side view.

(2) Photosensitive Drums and Bearing Members

Figures 6A, 6B:
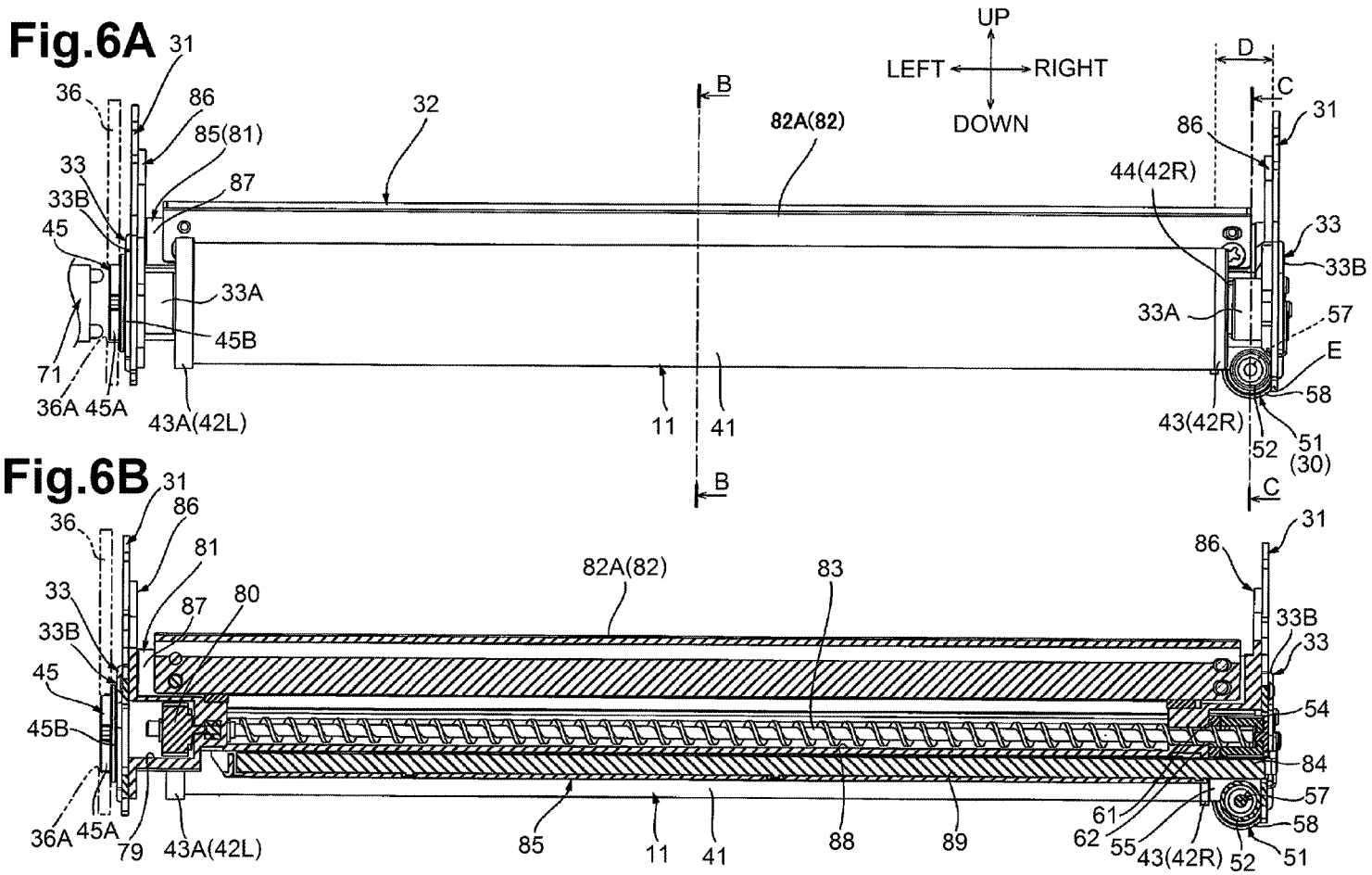
FIG. 6A is a front view depicting the drum unit depicted in FIG. 4 in the illustrative embodiment according to one or more aspects of the disclosure.
FIG. 6B is a sectional view taken along a line A-A of FIG. 4 in the illustrative embodiment according to one or more aspects of the disclosure.

As depicted in FIGS. 5 and 6A, each of the plurality of photosensitive drums 11 includes a drum body 41, a pair of flange members 42, and a drum coupling 45.

Each of the photosensitive drums 11 is disposed such that the drum body 41 thereof is located between the inner side-plates 31 so as to extend in the right-left direction. The drum body 41 includes a metal tube having a substantially cylindrical shape. The drum body 41 has a photosensitive layer on its peripheral surface. In each of the photosensitive drums 11, the drum body 41 is disposed such that each end thereof in the right-left direction is located more inward than a corresponding one of the inner side-plates 31 while a clearance D is left between each end of the drum body 41 and the corresponding one of the inner side-plates 31.

The flange members 42 are fitted to the right and left ends, respectively, of a corresponding drum body 41 so as not to be relatively rotatable. In the description below, one of the flange members 42 fitted to the left end of the drum body 41 is referred to as "left flange member 42L", and the other of the flange members 42 fitted to the right end of the drum body 41 is referred to as "right flange member 42R". Each of the flange members 42 includes a larger-diameter portion 43 and a smaller-diameter portion 44.

More specifically, each of the flange members 42 has the larger-diameter portion 43 at its inner end portion in the right-left direction. The larger-diameter portion 43 has a substantially cylindrical shape with its outer end portion closed in the right-left direction. An outside diameter of the larger-diameter portion 43 is substantially the same as an inside diameter of the drum body 41. Each of the flange member 42 is fitted to the drum body 41 such that a portion of the larger-diameter portion 43 thereof is positioned inside the drum body 41 while the outer end portion thereof in the right-left direction is exposed to the outside of the drum body 41 in the right-left direction. The left flange member 42L has a gear portion 43A at the larger-diameter portion 43.

The larger-diameter portion 43 of the left flange member 42L has the gear portion 43A at a left end portion thereof. The gear portion 43A has a substantially disk shape having thickness in the right-left direction. The gear portion 43A has teeth on an entire peripheral surface thereof.

In each of the flange members 42, the smaller-diameter portion 44 protrudes outward in the right-left direction from an outer wall of the larger-diameter portion 43 in the right-left direction. The smaller-diameter portion 44 has a substantially cylindrical shape. The smaller-diameter portion 44 has a central axis coaxial with a central axis of the larger-diameter portion 43. An outside diameter of the smaller-diameter portion 44 is smaller than the outside diameter of the larger-diameter portion 43.

In each of the photosensitive drums 11, the drum coupling 45 is disposed at a left end portion of each of the photosensitive drums 11. Each of the drum couplings 45 includes a coupling portion 45A and a collar portion 45B.

In each of the photosensitive drums 11, the drum coupling 45 has the coupling portion 45A at a left end portion thereof while the coupling portion 45A is disposed to the left of the left inner side-plate 31 (i.e. more outward than the left inner side-plate 31) in the right-left direction. Each of the coupling portions 45A has a substantially disk shape. An outside diameter of the coupling portion 45A is larger than the outside diameter of the smaller-diameter portion 44 of the left flange member 42L. The coupling portions 45A are configured to engage with respective printer-body couplings 71 of the printer body 2 so as not to be relatively rotatable.

In each of the drum couplings 45, the collar portion 45B protrudes outward in a diameter direction from a peripheral edge of a right end portion of the coupling portion 45A and extends in a circumferential direction of the coupling portion 45A. The collar portion 45B has a substantially ring shape. The collar portion 45B is disposed between a peripheral edge of a corresponding one of through holes 36A of the left outer side-plate 36 and the left inner side-plate 31. This configuration prevents or reduces the drum couplings 45 from moving leftward and coming off from the smaller-diameter portions 44 of the left flange members 42L, respectively.

Each of the drum couplings 45 further includes a shaft portion (not depicted) that extends rightward from a right surface of each of the coupling portion 45A. The drum couplings 45 are detachably fitted to the smaller-diameter portions 44 of the left flange members 42L, respectively, via the respective shaft portions. Nevertheless, the drum couplings 45 are not rotatable relative to the left flange members 42L, respectively.

The plurality of bearing members 33 are provided for the plurality of photosensitive drums 11, respectively, and more specifically, there are four pairs of bearing members 33. Each of the pairs of bearing members 33 supports both end portions of a corresponding one of the photosensitive drums 11 in the right-left direction. Each of the plurality of bearing members 33 includes a cylinder portion 33A and a collar portion 33B.

The cylinder portion 33A has a substantially cylindrical shape extending in the right-left direction. The cylinder portion 33A has an inside diameter that is substantially the same as the outside diameter of the smaller-diameter portion 44 of each of the flange members 42. The cylinder portion 33A has an outside diameter that is substantially the same as a diameter of an incircle that inscribes a plurality of flat surfaces of the through hole 37 of the inner side-plate 31. The cylinder portion 33A of the bearing member 33 is fitted to a corresponding one of the smaller-diameter portions 44 of the flange members 42, from the outside in the diameter direction so as to be rotatable relative to the corresponding flange member 42. The cylinder portion 33A is further fitted in a corresponding one of the through holes 37 of one of the inner side-plates 31 and a corresponding one of pass-through holes 90 that are defined in wall portions 86, respectively, of each cleaner frame 81.

In each of the plurality of bearing members 33, the collar portion 33B protrudes outward from a peripheral surface of the cylinder portion 33A in the right-left direction and extends in the circumferential direction of the cylinder portion 33A. The collar portion 33B has a substantially ring shape. The collar portions 33B are in contact with an outer surface of one of the inner side-plates 31 from the outside in the right-left direction.

(3) Drum Cleaning Unit

The drum cleaning unit 30 includes a plurality of drum cleaners 32, a waste-toner conveyor member 51, and a plurality of seal members 61.

(3-1) Drum Cleaners

Figure 7A:
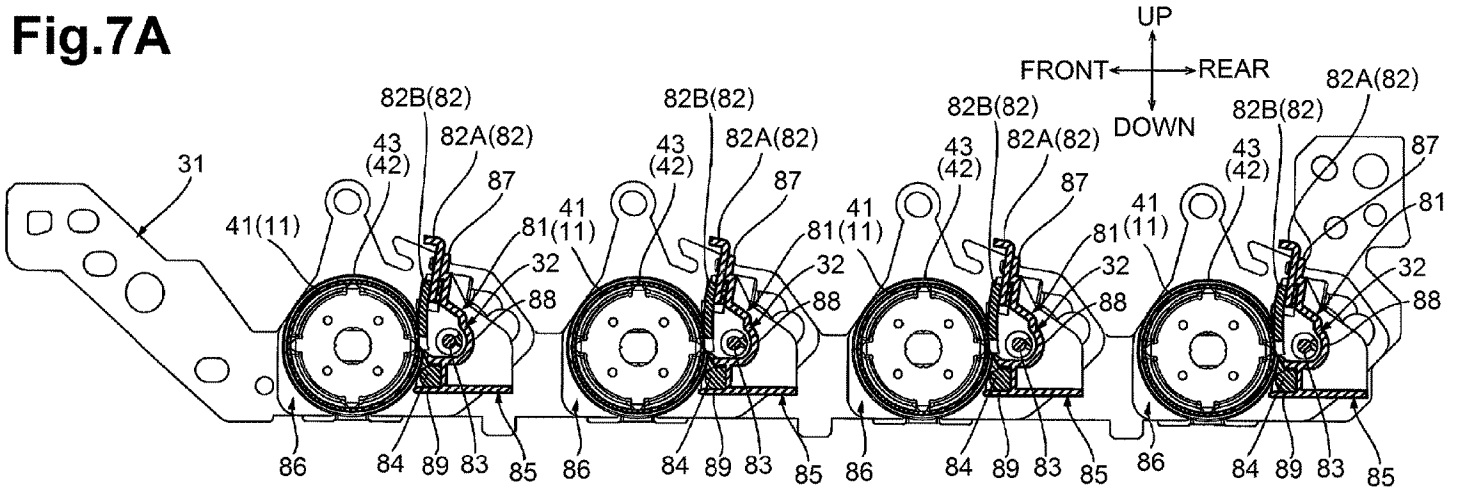
FIG. 7A is a sectional view taken along a line B-B of FIG. 6A in the illustrative embodiment according to one or more aspects of the disclosure.

As depicted in FIGS. 6B and 7A, the plurality of drum cleaners 32 are provided for the plurality of photosensitive drums 11, respectively, and are disposed behind the photosensitive drums 11, respectively. Each of the plurality of drum cleaners 32 includes the cleaner frame 81, a cleaning blade 82, a first auger member 83, and a static eliminating member 84.

Each of the cleaner frames 81 includes a body portion 85, the pair of wall portions 86, a pair of bosses 81A (see FIG. 5), and a pair of threaded holes 81B (see FIG. 5).

The body portion 85 is disposed at a rear end portion of the cleaner frame 81. The body portion 85 extends in the right-left direction and has a substantially rectangular cylindrical shape with its ends closed in the right-left direction. The body portion 85 includes a blade support portion 87, a waste-toner conveyor portion 88, a gear accommodating portion 79, and a static-eliminating-member support portion 89.

The blade support portion 87 is disposed at an upper end portion of the body portion 85. The blade support portion 87 has a substantially plate shape extending in the right-left direction.

The waste-toner conveyor portion 88 is disposed below the blade support portion 87. The waste-toner conveyor portion 88 extends in the right-left direction. The waste-toner conveyor portion 88 has a substantially semicircular cylindrical shape. The waste-toner conveyor portion 88 has a closed left end and open right and front ends. An upper end portion of the waste-toner conveyor portion 88 is contiguous to a lower end portion of the blade support portion 87.

The gear accommodating portion 79 is disposed to the left of the waste-toner conveyor portion 88 as depicted in FIG. 6B. The gear accommodating portion 79 extends in the right-left direction. The gear accommodating portion 79 has a substantially semicircular cylindrical shape. The gear accommodating portion 79 has closed right and left ends and an open front end.

The static-eliminating-member support portion 89 is disposed below the waste-toner conveyor portion 88. The static-eliminating-member support portion 89 extends in the right-left direction. The static-eliminating-member support portion 89 has a substantially rectangular cylindrical shape with its front end opened. An upper end portion of the static-eliminating-member support portion 89 is contiguous to a lower end portion of the waste-toner conveyor portion 88.

The wall portions 86 are disposed at both end portions, respectively, of the cleaner frame 81 in the right-left direction. Each of the wall portions 86 has a substantially plate shape. The wall portions 86 extend forward from the respective right and left end portions of the body portion 85 in the right-left direction. The wall portions 86 are in contact with inner surfaces of the inner side-plates 31, respectively. As depicted in FIG. 5, each of the wall portions 86 has the pass-through hole 90.

The pass-through hole 90 is defined in a substantially middle portion of each of the wall portions 86. Each of the pass-through hole 90 has a substantially circular shape in side view. The pass-through holes 90 and the through holes 37 of the inner side-plates 31 have an identical shape and are disposed at the same position when projected in the right-left direction.

The bosses 81A are disposed at both end portions of the cleaner frame 81 in the right-left direction. Each of the bosses 81A has a substantially circular cylindrical shape and protrudes outward in the right-left direction from an outer surface of the body portion 85 in the right-left direction. The bosses 81A are fitted in the corresponding boss pass-through holes 28 of the inner side-plates 31, respectively.

The threaded holes 81B are defined below and rearward of the bosses 81A, respectively. Each of the threaded holes 81B has a substantially circular shape in side view and recessed inward than the outer surface of the body portion 85 in the right-left direction.

The cleaning blade 82 includes a support member 82A and a blade body 82B.

The support member 82A is made of, for example, metal and has a substantially plate shape extending in the right-left direction. The support member 82A is fixed to the blade support portion 87 of the cleaner frame 81.

The blade body 82B is made of an elastic member, for example, rubber. The blade body 82B has a substantially plate shape extending in the right-left direction. An upper end portion of the blade body 82B is fixed to the support member 82A. A lower end portion of the blade body 82B faces a front portion of the waste-toner conveyor portion 88 to cover an upper half of the waste-toner conveyor portion 88. The lower end portion of the blade body 82B is curved toward the rear and is in contact with a rear end portion of the drum body 41 of a corresponding one of the photosensitive drums 11.

The first auger member 83 is disposed inside the waste-toner conveyor portion 88. The first auger member 83 extends in the right-left direction. A left end portion of the first auger member 83 is supported by a wall that is disposed between the gear accommodating portion 79 and the waste-toner conveyor portion 88 so as to be relatively rotatable. The left end portion of the first auger member 83 passes through the gear accommodating portion 79 and the waste-toner conveyor portion 88 and is disposed inside the gear accommodating portion 79. The first auger member 83 includes a first auger member gear 80.

The first auger member gear 80 is disposed inside the gear accommodating portion 79 and is supported by the left end portion of the first auger member 83 so as not to be rotatable relative to the first auger member 83. The first auger member gear 80 has a substantially circular cylindrical shape extending in the right-left direction. The first auger member gear 80 has teeth on its entire peripheral surface. The first auger member gear 80 is in mesh with a corresponding one of the larger-diameter portions 43 of the left flange members 42L of the photosensitive drums 11 (see FIG. 8).

The static eliminating member 84 is fixedly disposed inside the static-eliminating-member support portion 89. The static eliminating member 84 has a semicircular column shape extending in the right-left direction. A front surface of the static eliminating member 84 protrudes at its middle portion in the up-down direction and has a substantially arc shape in side view. The center of curvature A1 of the front surface of the static eliminating member 84 is disposed at a position more forward than the center of rotation A2 of the first auger member 83. In other words, the center of rotation A2 of the first auger member 83 is disposed opposite to a corresponding photosensitive drum 11 in the front-rear direction with respect to the center of curvature A1 of the front surface of the static eliminating member 84. The static eliminating member 84 is configured to expose the surface of a corresponding photosensitive drum 11 with light after a toner image is transferred onto a sheet P from the corresponding photosensitive drum 11 and before foreign matters are removed using the cleaning blade 82, thereby reducing a charge of static electricity on the surface of the corresponding photosensitive drum 11.

(3-2) Waste-Toner Conveyor Member and Seal Members

As depicted in FIGS. 5 and 6A, the waste-toner conveyor member 51 is disposed in the clearance D that extends between the drum bodies 41 of the photosensitive drums 11 and the right inner side-plate 31. The waste-toner conveyor member 51 includes a conveyor tube 52, a plurality of connectors 53, a second auger member 57 (see FIG. 6B), and a second auger member gear 58.

Figure 9A:
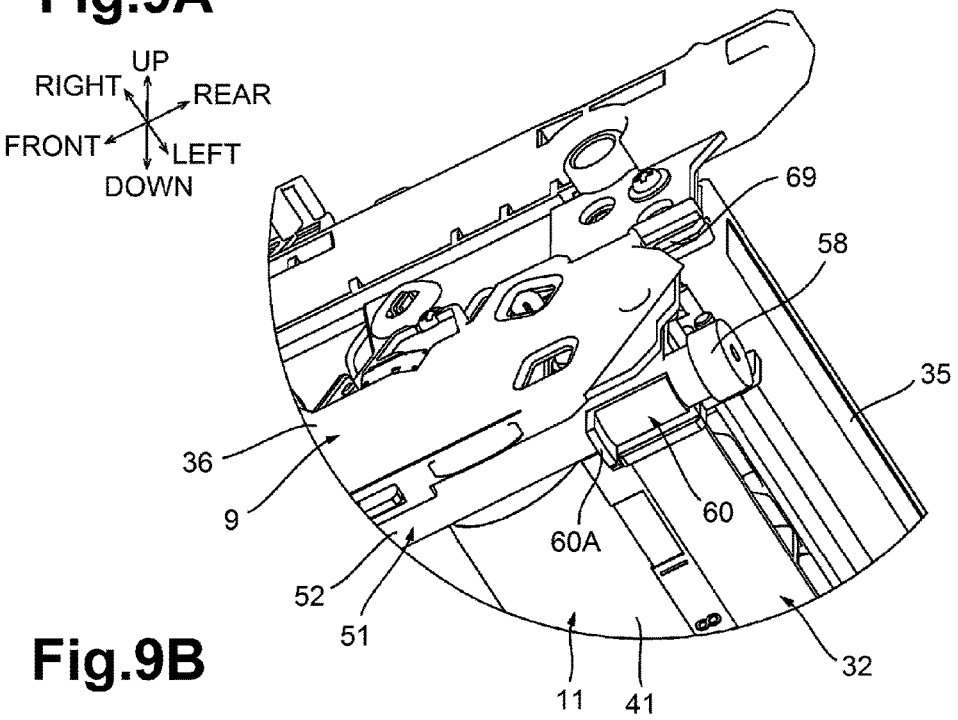
FIG. 9A is a diagram for explaining a movement of a shutter of a conveyor tube depicted in FIG. 7B in the illustrative embodiment according to one or more aspects of the disclosure, wherein the shutter is located at a closed position.
Figure 9B:
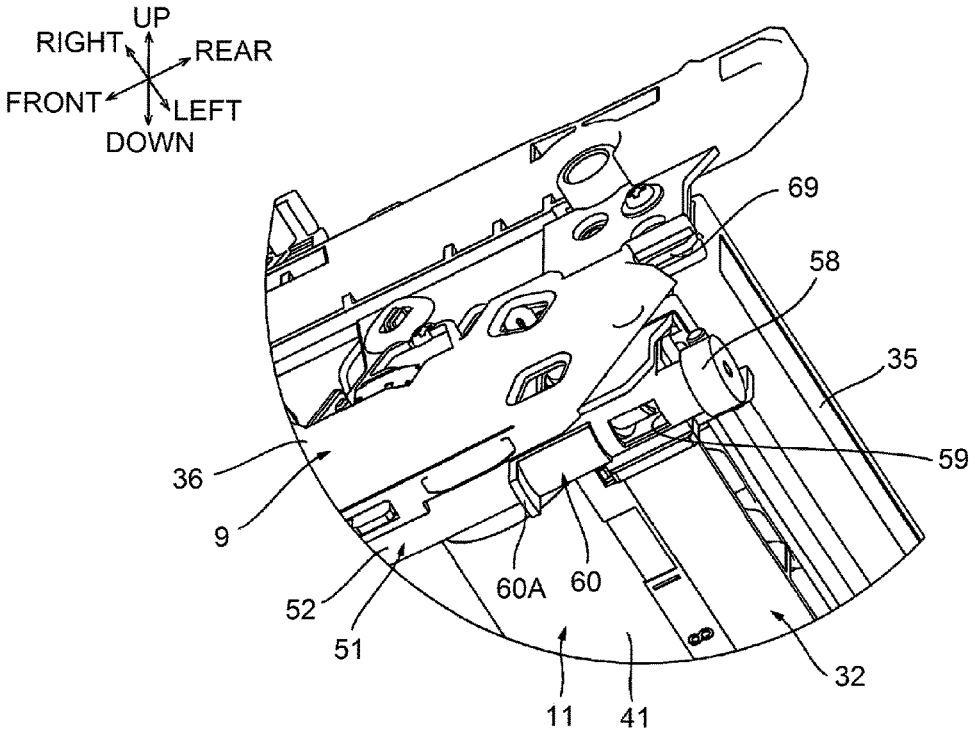
FIG. 9B is a diagram for explaining the movement of the shutter of the conveyor tube depicted in FIG. 7B in the illustrative embodiment according to one or more aspects of the disclosure, wherein the shutter is located at an open position.

The conveyor tube 52 extends in the front-rear direction and has a substantially cylindrical shape with its both ends in the front-rear direction closed. A larger portion of the conveyor tube 52 is located at a higher position than lower ends E of the inner side-plates 31. The conveyor tube 52 overlaps the smaller-diameter portions 44 of the right flange members 42R and right end portions of the static eliminating members 84 when projected in the up-down direction. An upper half portion of the conveyor tube 52 overlaps lower end portions of the drum bodies 41 when projected in the right-left direction. As depicted in FIGS. 9A and 9B, the conveyor tube 52 has an opening 59 therein and includes a shutter 60.

The opening 59 is defined in a rear end portion of the conveyor tube 52. The opening 59 penetrates a lower end of a peripheral wall of the conveyor tube 52 in the up-down direction, and has a substantially rectangular shape in bottom view.

The shutter 60 is disposed at the rear end portion of the conveyor tube 52. The shutter 60 extends in the front-rear direction. The shutter 60 has a substantially rectangular plate shape in bottom view. Both end portions in the right-left direction of the shutter 60 are curved upward along the peripheral wall of the conveyor tube 52. The shutter 60 is configured to move along the front-rear direction, between a closed position, at which the shutter 60 closes the opening 59 (see FIG. 9A), and an open position, at which the shutter 60 exposes the opening 59 (see FIG. 9B). The shutter 60 is urged toward the closed position by an urging member (not depicted) at all times. The shutter 60 includes a contact rib 60A.

The contact rib 60A protrudes downward from a front end portion of the shutter 60. The contact rib 60A has a substantially flat-plate shape extending in the right-left direction.

As depicted in FIG. 5, the plurality of connectors 53 are disposed above the conveyor tube 52 and are spaced apart from each other in the front-rear direction. The plurality of connectors 53 are provided for the plurality of drum cleaners 32, respectively, and more specifically, there are four connectors 53 disposed. Each of the plurality of connectors 53 includes a connecting portion 54, a communication portion 55, and a fixed portion 56.

As depicted in FIGS. 5 and 6B, the connecting portion 54 is disposed at an upper-front end portion of the connector 53. The connecting portion 54 extends in the right-left direction. The connecting portion 54 has an open left end and a closed right end. The connecting portion 54 has a substantially cylindrical shape. The connecting portion 54 is connected to the right end portion of the waste-toner conveyor portion 88 of a corresponding drum cleaner 32 via a corresponding seal member 61 such that the connecting portion 54 closes the right end portion of the waste-toner conveyor portion 88 of the corresponding drum cleaner 32. A right end portion of the first auger member 83 is disposed inside of a corresponding connecting portion 54.

Figure 7B:
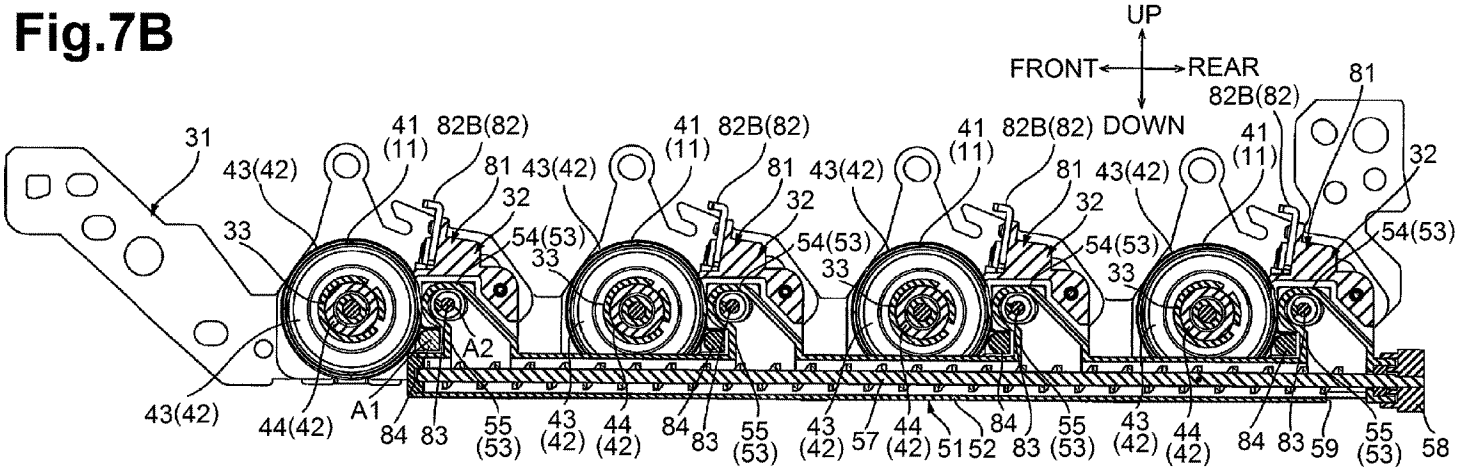
FIG. 7B is a sectional view taken along a line C-C of FIG. 6A in the illustrative embodiment according to one or more aspects of the disclosure.

As depicted in FIGS. 5 and 7B, the communication portion 55 is disposed rearward of the static eliminating member 84 and the connecting portion 54 and below the connecting portion 54. The communication portion 55 has a substantially rectangular cylindrical shape extending in the up-down direction. An upper-front end portion of the communication portion 55 is in communication with a lower-rear end portion of the connecting portion 54. A lower end portion of the communication portion 55 is in communication with an upper end portion of the conveyor tube 52.

As depicted in FIG. 5, the fixed portion 56 is disposed at an upper rear end portion of the connector 53. The fixed portion 56 has a substantially rectangular plate shape in side view and extends upward from a right end portion of the communication portion 55. The fixed portion 56 has a screw pass-through hole 56A.

The screw pass-through hole 56A is defined in a middle portion of the fixed portion 56. The screw pass-through hole 56A penetrates the fixed portion 56 in the right-left direction. Of the plurality of connectors 53, the screw pass-through hole 56A of the foremost connector 53 has a substantially circular shape in side view. The screw pass-through holes 56A of the other connectors 53 each are elongated in the front-rear direction and have a substantially oval shape in side view. The screw pass-through hole 56A faces a corresponding screw pass-through hole 29 of the right inner side-plate 31 and a corresponding threaded hole 81B of the cleaner frame 81 in the right-left direction. The fixed portion 56 is fixed to a right wall of the cleaner frame 81 together with the right inner side-plate 31 using a screw 50 that is screwed in the threaded hole 81B of the cleaner frame 81 through the screw pass-through hole 29 of the right inner side-plate 31 and the screw pass-through hole 56A of the fixed portion 56.

As described above, the screw pass-through hole 56A of the foremost connector 53 has a substantially circular shape in side view. This configuration prevents the movement of the waste-toner conveyor member 51 in the up-down direction and in the front-rear direction relative to the cleaner frames 81. As described above, the screw pass-through holes 56A of the other connectors 53 each are elongated in the front-rear direction and have a substantially oval shape in side view. This configuration permits the movement of the waste-toner conveyor member 51 in the front-rear direction relative to the cleaner frames 81 while preventing the movement of the waste-toner conveyor member 51 in the up-down direction relative to the cleaner frames 81.

As depicted in FIG. 7B, the second auger member 57 is disposed inside the conveyor tube 52. The second auger member 57 extends in the front-rear direction. That is, a central axis A3 of the second auger member 57 extends in the front-rear direction. The second auger member 57 overlaps the smaller-diameter portions 44 of the right flange members 42R and the right end portions of the static eliminating members 84 when projected in the up-down direction. An upper half portion of the second auger member 57 overlaps the lower end portions of the drum bodies 41 when projected in the right-left direction. A front end portion of the second auger member 57 is supported by the front wall of the conveyor tube 52 so as to be relatively rotatable. A rear end portion of the second auger member 57 is supported by a rear wall of the conveyor tube 52 and extends rearward beyond the rear wall of the conveyor tube 52.

The second auger member gear 58 is supported by the rear end portion of the conveyor tube 52 so as to be relatively rotatable and supports the rear end portion of the second auger member 57 so as not to be relatively rotatable. The second auger member gear 58 has a substantially circular cylindrical shape extending in the front-rear direction. The second auger member gear 58 has angled teeth on an entire peripheral surface.

As depicted in FIGS. 5 and 6B, the plurality of seal members 61 are provided for the plurality of drum cleaners 32, respectively, and more specifically, there are four seal members 61 disposed. Each of the plurality of seal members 61 is disposed between the waste-toner conveyor portion 88 of a corresponding drum cleaner 32 and a corresponding connecting portion 54 under compression. Thus, each of the plurality of seal members 61 seals the gap between the waste-toner conveyor portion 88 of the corresponding drum cleaner 32 and the corresponding connecting portion 54. Each of the plurality of seal members 61 is made of an elastic member, for example, sponge, and has a substantially rectangular flat-plate shape in side view. The plurality of seal members 61 each have a pass-through hole 62.

The pass-through hole 62 is defined in a middle portion of each of the seal members 61. The pass-through hole 62 penetrates the seal member 61 in the right-left direction. The pass-through hole 62 is elongated in the front-rear direction and has a substantially oval shape in side view.

(4) Rotation Member

Figure 8:
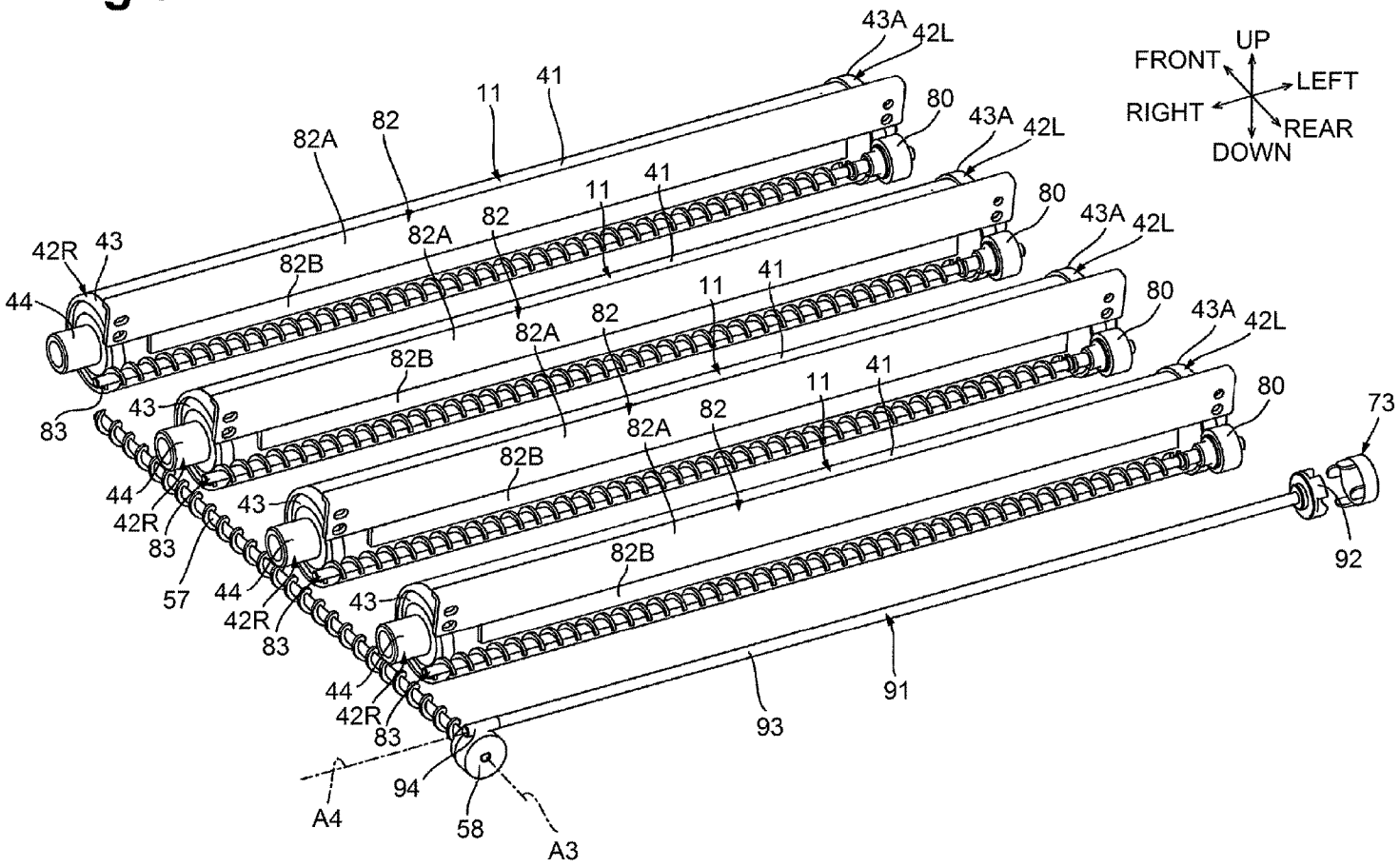
FIG. 8 is a diagram for explaining transmission of driving force to first auger members and a second auger member depicted in FIG. 7B in the illustrative embodiment according to one or more aspects of the disclosure.

As depicted in FIGS. 2 and 8, the rotation member 91 is disposed at the rear end portion of the drum unit 9. The rotation member 91 includes a drive shaft 93, a coupling member 92, and a worm 94.

The drive shaft 93 has a substantially circular cylindrical shape extending in the right-left direction. The drive shaft 93 has a central axis A4 that extends in the right-left direction. Both end portions in the right-left direction of the drive shaft 93 is rotatably supported by support plates 95, respectively of the rearmost cleaner frame 81. The support plates 95 extend rearward from the right and left end portions, respectively, of the rearmost cleaner frame 81. Each of the support plates 95 has a substantially flat-plate shape.

The coupling member 92 is disposed at a left end portion of the rotation member 91. The coupling member 92 has a substantially circular cylindrical shape extending in the right-left direction. The central axis A4 is a common axis of the coupling member 92 and the drive shaft 93. The coupling member 92 is supported by the left end portion of the drive shaft 93 so as not to be rotatable relatively. The coupling member 92 is rotatably supported by a through hole 36B (see FIG. 3) defined in a rear lower end portion of the left outer side-plate 36. That is, the coupling member 92 is disposed more leftward than the drum bodies 41 of the photosensitive drums 11. The coupling member 92 is configured to engage with the printer-body coupling 73 of the printer body 2 so as not to be relatively rotatable.

The worm 94 is disposed at a right end portion of the rotation member 91. The worm 94 has a substantially circular cylindrical shape extending in the right-left direction. The central axis A4 is also a common axis of the worm 94 and the drive shaft 93. The worm 94 is supported by a right end portion of the drive shaft 93 so as not to be relatively rotatable. The worm 94 has a thread on its peripheral surface. The worm 94 is in mesh with an upper end portion of the second auger member gear 58.

(5) Front Plate, Rear Plate, and Outer Side-Plates

As depicted in FIG. 2, the front plate 34 is disposed at a front end portion of the drum unit 9. The front plate 34 has a substantially rectangular flat-plate shape in front view extending in the right-left direction. The front plate 34 is disposed between front end portions of the opposite inner side-plates 31. The front plate 34 includes a front handle 34A.

The front handle 34A is disposed at a middle portion of the front plate 34 in the right-left direction. The front handle 34A protrudes forward from a front surface of the front plate 34 and has a substantially plate shape extending in the right-left direction.

The rear plate 35 is disposed at a rear end portion of the drum unit 9. The rear plate 35 has a substantially rectangular flat-plate shape in front view extending in the right-left direction. The rear plate 35 is disposed between rear end portions of the opposite inner side-plates 31. The rear plate 35 has a rear handle 35A.

The rear handle 35A is disposed at an upper end portion of the rear plate 35. The rear handle 35A protrudes upwardly forward from an upper surface of the rear plate 35 and extends in the right-left direction. The rear handle 35A has a substantially rectangular frame shape in rear view. The rear handle 35A is disposed more forward than the opening 59 of the conveyor tube 52 (see FIG. 10).

Figure 3:
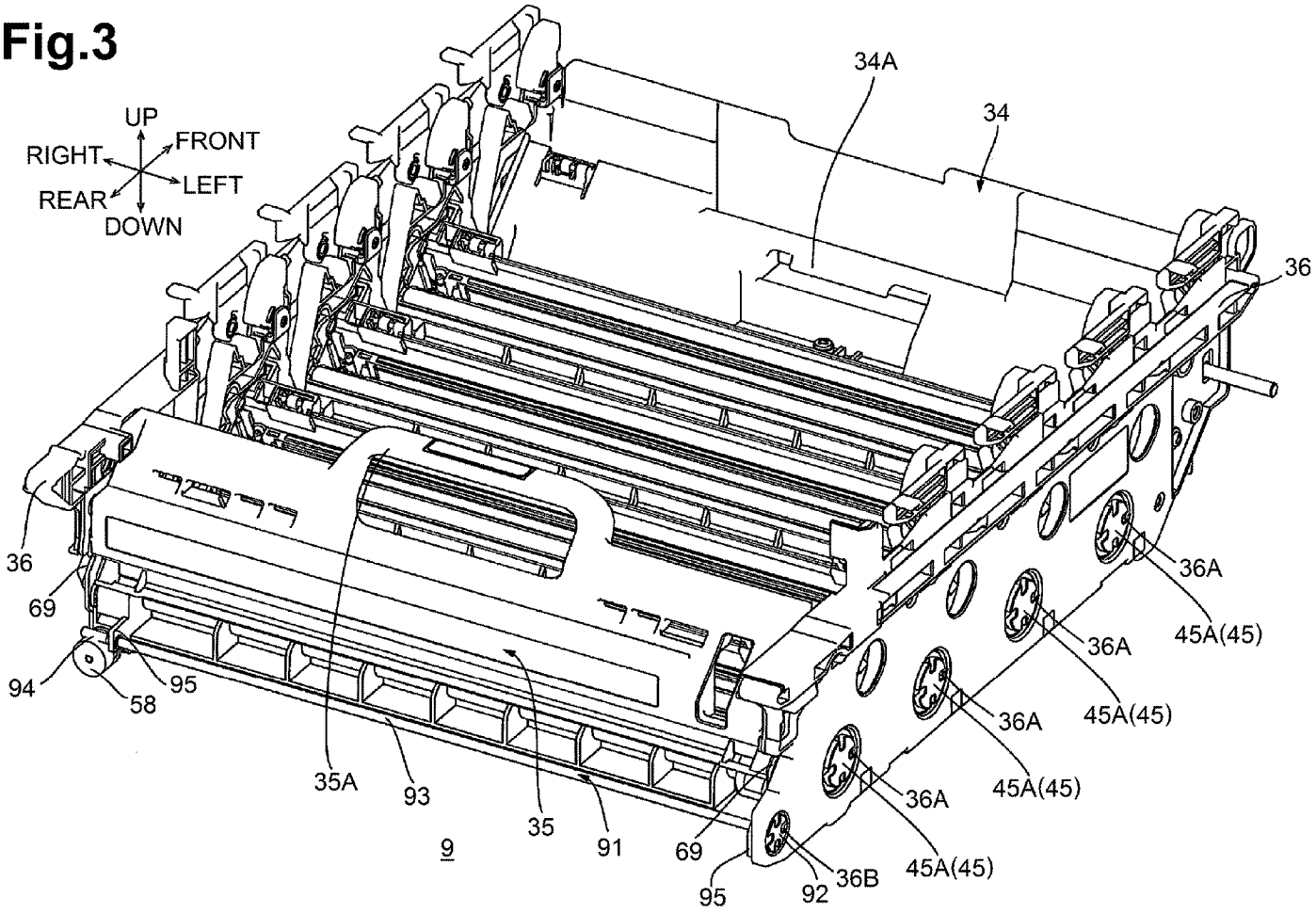
FIG. 3 is a left rear perspective view depicting the drum unit depicted in FIG. 2 in the illustrative embodiment according to one or more aspects of the disclosure.

The outer side-plates 36 are disposed more outward than the inner side-plates 31 opposite thereto, respectively, in the right-left direction. The outer side-plates 36 are made of, for example, resin. The outer side-plates 36 each have a substantially rectangular flat-plate shape in side view. The outer side-plates 36 have a dimension in the up-down direction greater than a dimension in the up-down direction of the inner side-plates 31. As depicted in FIG. 3, the left outer side-plate 36 has the plurality of through holes 36A and the through hole 36B therein. The coupling portions 45A of the drum couplings 45 are rotatably fitted in the plurality of through holes 36A, respectively. The coupling member 92 of the rotation member 91 is rotatably fitted in the through hole 36B. As depicted in FIG. 6A, portions surrounding the through holes 36A of the left outer side-plate 36 are opposite to the left portions of the collar portions 45B of the drum couplings 45.

3. Configuration of Printer Body

Figure 11A:
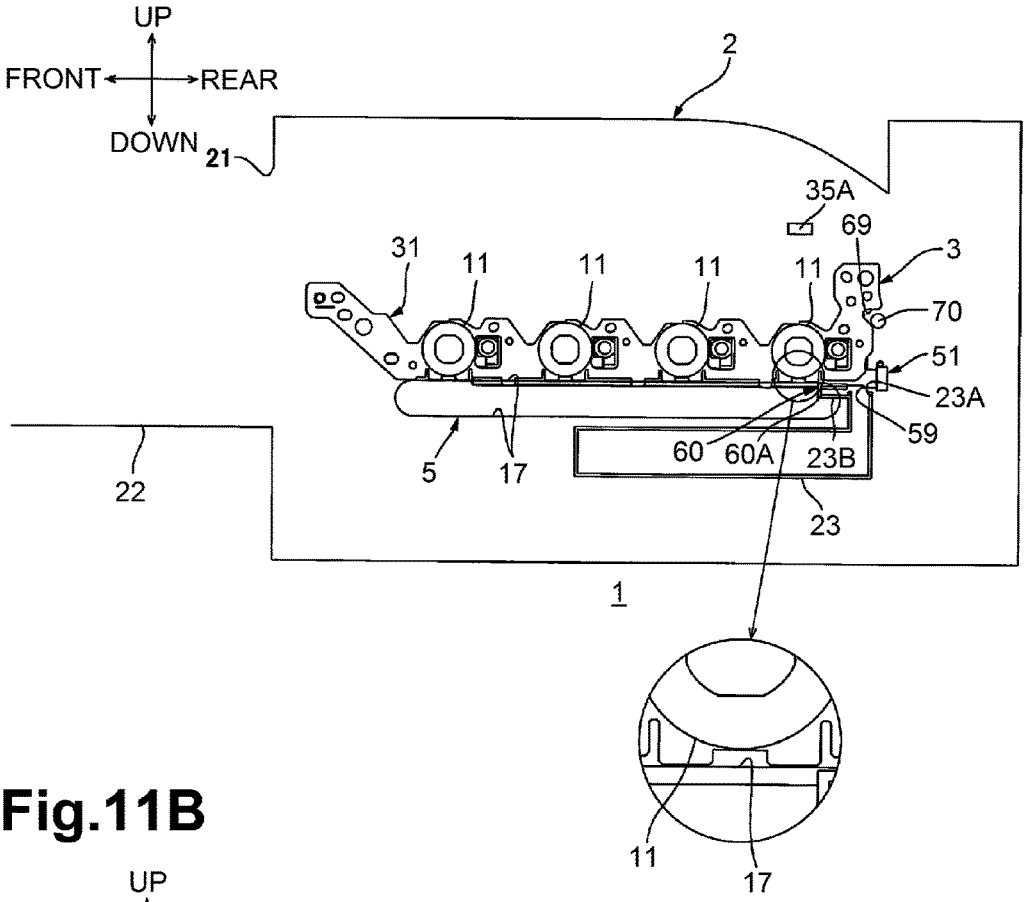
FIG. 11A illustrates still another step subsequent to or prior to the step of FIG. 10B in one of installing and pulling-out of the drum unit with respect to the printer body in the illustrative embodiment according to one or more aspects of the disclosure, wherein the drum unit is located at a separated position and a shutter is located at a position slightly shifted toward the closed position from the open position.
Figure 11B:
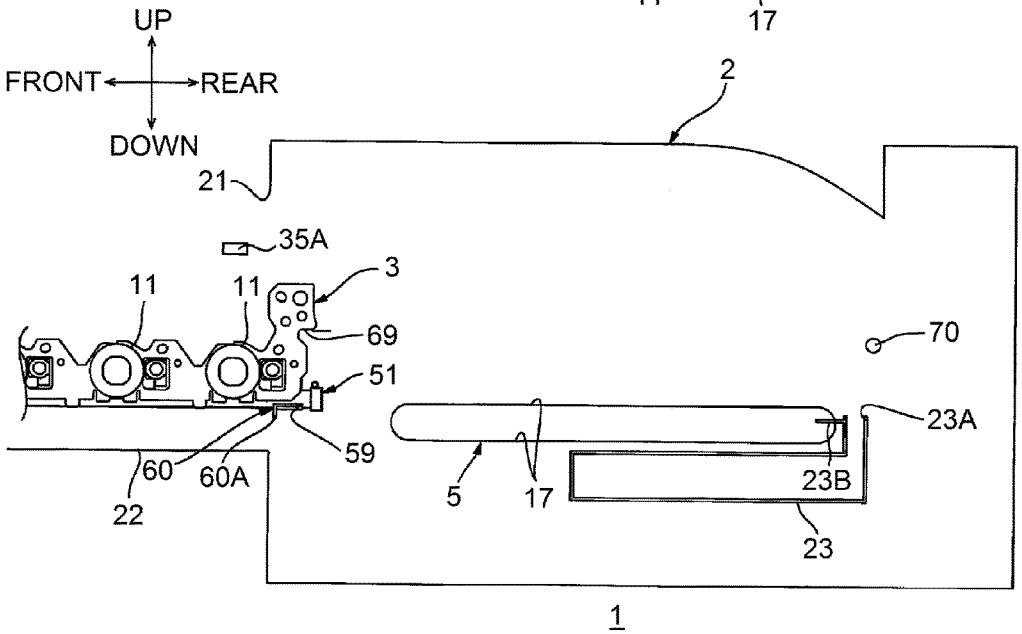
FIG. 11B illustrates yet another step subsequent to or prior to the step of FIG. 11A in one of installing and pulling-out of the drum unit with respect to the printer body in the illustrative embodiment according to one or more aspects of the disclosure, wherein the drum unit is located at a pulled-out position in the illustrative embodiment according to one or more aspects of the disclosure.

As depicted in FIG. 11B, the printer body 2 includes a waste-toner storage portion 23 and a reference shaft 70.

The waste-toner storage portion 23 is disposed below the transfer unit 5. The waste-toner storage portion 23 has a substantially box shape. The waste-toner storage portion 23 includes a take-in tube 23A and a protrusion 23B.

The take-in tube 23A is disposed at right-rear end portion of the waste-toner storage portion 23. The take-in tube 23A has a substantially cylindrical shape extending in the up-down direction. The take-in tube 23A has an open upper end. The take-in tube 23A is in communication with an internal space of the waste-toner storage portion 23 through a lower end of the take-in tube 23A.

The protrusion 23B is disposed at an upper end portion of the take-in tube 23A. The protrusion 23B has a substantially plate shape and extends forward from the upper end portion of the take-in tube 23A.

The reference shaft 70 is disposed at a rear end portion inside the printer body 2. The reference shaft 70 is made of, for example, metal, and has a substantially circular cylindrical shape extending in the right-left direction.

4. Pulling-Out and Installing Drum Unit

Figure 10A:
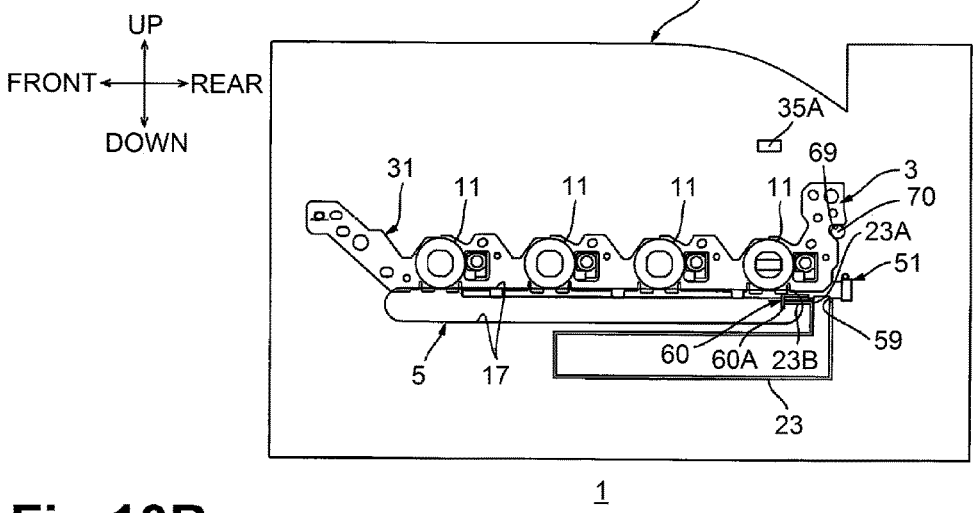
FIG. 10A illustrates a step in one of installing and pulling-out of the drum unit with respect to a printer body in the illustrative embodiment according to one or more aspects of the disclosure, wherein the drum unit is located at an installed position.

In a state where the drum unit 9 is located at the installed position in the printer body 2, as depicted in FIG. 10A, the notches 69 of the right and left inner side-plates 31 are in engagement with right and left end portions, respectively, of the reference shaft 70 in the right-left direction. With this engagement, the drum unit 9 is positioned at the installed position.

In the state where the drum unit 9 is located at the installed position, all of the plurality of photosensitive drums 11 are in contact with an upper portion of the conveyor belt 17 and the shutter 60 of the conveyor tube 52 is located at the open position. Further, the contact rib 60A of the shutter 60 is in contact with a front end portion of the protrusion 23B of the waste-toner storage portion 23, and the opening 59 of the conveyor tube 52 is connected with the upper end portion of the take-in tube 23A of the waste-toner storage portion 23. The conveyor tube 52 is in communication with the upper end portion of the take-in tube 23A of the waste-toner storage portion 23 via the opening 59.

Figure 10B:
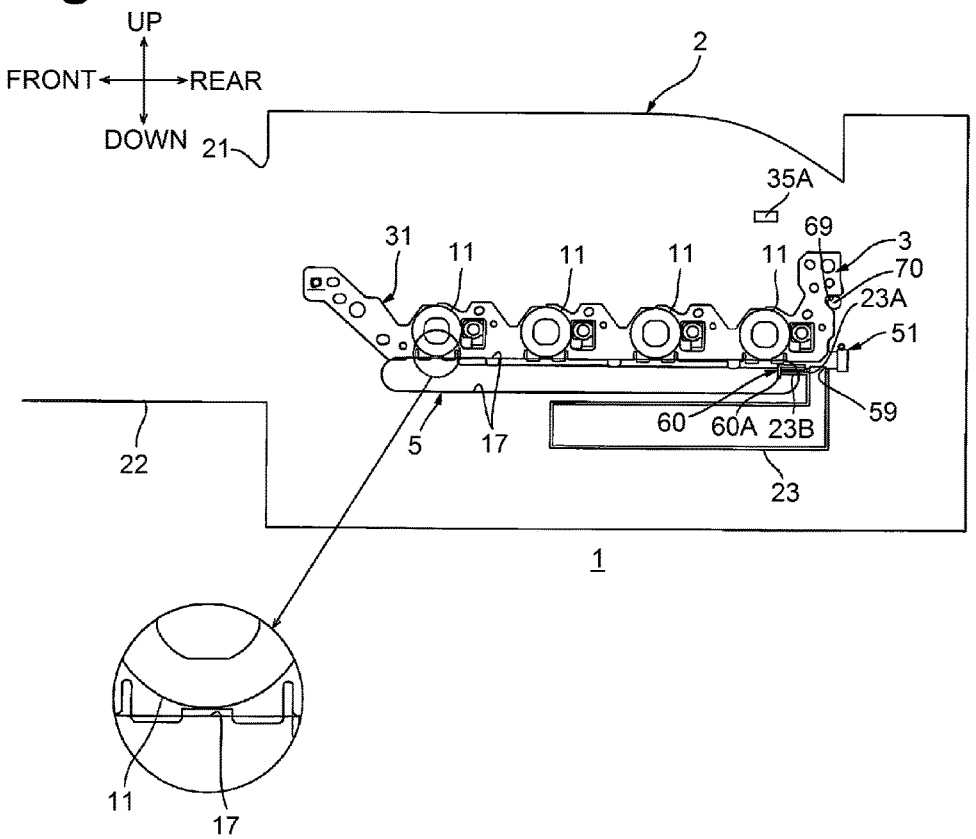
FIG. 10B illustrates another step subsequent to or prior to the step of FIG. 10A in one of installing and pulling-out of the drum unit with respect to the printer body in the illustrative embodiment according to one or more aspects of the disclosure, wherein a front cover of the printer body is opened and a front end portion of the drum unit is located at a slightly upward position

In order to pull out the drum unit 9 to the pulled-out position, an operator opens the front cover 22 of the printer body 2 in a first step as depicted in FIG. 10B.

In synchronization with the opening of the front cover 22, a front end portion of the drum unit 9 is pressed upward by a pressing member (not depicted). Thus, the front end portion of the drum unit 9 moves slightly upward so that the foremost photosensitive drum 11 moves slightly upward to come apart from the upper portion of the conveyor belt 17, and therefore, the drum unit 9 is inclined while its front end portion is located at a slightly higher position than its rear end portion.

Subsequently, the operator holds the front handle 34A of the drum unit 9 and pulls the drum unit 9 forward.

Thus, the drum unit 9 is moved slightly forward and upward while the drum unit 9 is guided by a guide (not depicted).

Meanwhile, the rear end portion of the drum unit 9 moves upward and forward greater than the front end portion of the drum unit 9 such that the rearmost photosensitive drum 11 comes apart from the upper portion of the conveyor belt 17 while the rear end portion of the drum unit 9 is guided by the guide.

Thus, as depicted in FIG. 11A, the drum unit 9 is located at a separated position, at which all of the plurality of photosensitive drums 11 are separated from the conveyor belt 17.

In this state, the drum unit 9 is held in a horizontal position, and the contact rib 60A of the shutter 60 overlaps the protrusion 23B of the waste-toner storage portion 23 in the front-rear direction. Further, the shutter 60 is located at a position slightly rearward toward the closed position by an urging force from the urging member (not depicted) in accordance with the forward movement of the drum unit 9 while the contact rib 60A of the shutter 60 is in contact with the front end of the protrusion 23B of the waste-toner storage portion 23.

Then, the operator further pulls the drum unit 9 forward with holding the front handle 34A of the drum unit 9.

In accordance with the forward movement of the drum unit 9, the shutter 60 moves further rearward and is thus located at the closed position due to the urging force of the urging member.

After that, the operator further pulls the drum unit 9, via the opening 21, to a position where the rear handle 35A is exposed to the outside. When the drum unit 9 is located at this position, a further forward movement of the drum unit 9 is restricted by a stopper (not depicted). Thus, as depicted in FIG. 11B, the drum unit 9 is positioned at the pulled-out position.

In this state, the rear end portion of the drum unit 9, more specifically, a portion of the drum unit 9 further rearward than the rear handle 35A, is located inside the printer body 2. That is, the opening 59 of the conveyor tube 52 is located inside the printer body 2.

As the drum unit 9 becomes in the above state, the pulling-out operation is completed.

In order to install the drum unit 9 at the installed position, the operator reverses the pulling-out procedure.

More specifically, the operator holds the front handle 34A of the drum unit 9 and moves the drum unit 9 rearward from the pulled-out position.

In response to this, the drum unit 9 moves rearward. Before the drum unit 9 reaches the separated position, the contact rib 60A of the shutter 60 comes into contact with the front end of the protrusion 23B of the waste-toner storage portion 23.

As the operator moves the drum unit 9 further rearward, the shutter 60 moves forward toward the open position against the urging force of the urging member with the rearward movement of the drum unit 9.

As depicted in FIG. 11A, when the drum unit 9 is located at the separated position, the opening 59 is substantially completely opened and faces the upper end portion of the take-in tube 23A of the waste-toner storage portion 23.

Then, as the operator moves the drum unit 9 further rearward, the drum unit 9 moves rearward and downward while the drum unit 9 is guided by the guide, whereby the drum unit 9 is located at the installed position while its front end portion is located at a slightly higher position than its rear end portion as depicted in FIG. 10B.

In this state, the shutter 60 of the conveyor tube 52 is located at the open position, and the opening 59 of the conveyor tube 52 is connected with the upper end portion of the take-in tube 23A of the waste-toner storage portion 23.

In synchronization with closing of the front cover 22 by the operator, as depicted in FIG. 10A, the front end portion of the drum unit 9 becomes free from the pressure of the urging member, whereby the front end portion of the drum unit 9 moves downward. Thus, all of the plurality of photosensitive drums 11 come into contact with an upper portion of the conveyor belt 17.

As the drum unit 9 becomes in the above state, the installation operation is completed.

5. Transmission of Driving Force to First Auger Members and Second Auger Member

As the installation of the drum unit 9 is completed, as depicted in FIG. 6A, the printer-body couplings 71 of the printer body 2 move rightward in synchronization of closing of the front cover 22, and the printer-body couplings 71 of the printer body 2 thus come into engagement with the drum couplings 45 of the photosensitive drums 11, respectively.

As depicted in FIG. 8, the printer-body coupling 73 of the printer body 2 also moves rightward and comes into engagement with the coupling member 92 of the rotation member 91.

As an image forming operation starts, driving force is inputted into the drum couplings 45 of the photosensitive drums 11 via the printer-body couplings 71 of the printer body 2 and into the coupling member 92 of the rotation member 91 via the printer-body coupling 73 of the printer body 2.

Thus, the photosensitive drums 11 and the rotation member 91 rotate by the transmission of the driving force.

With the rotation of the photosensitive drums 11, the driving force is further transmitted to the first auger member gears 80 via the gear portions 43A of the left flange members 42L, respectively, whereby the first auger member gears 80 rotate.

With the rotation of the rotation member 91, the driving force is further transmitted to the second auger member gear 58 via the worm 94, whereby the second auger member gear 58 rotates.

6. Drum Cleaning

In the image forming operation, after toner images are transferred onto one or more sheets P, there may be a case where toner may remain on the surfaces of the photosensitive drums 11 without being transferred onto the one or more sheets P (hereinafter, referred to as "waste toner") or paper dust may adhere to the surfaces of the photosensitive drums 11 from the one or more sheets P.

As depicted in FIG. 7A, foreign matters such as waste toner and/or paper dust, are removed from the surfaces of the photosensitive drums 11 using the cleaning blades 82 during rotation of the photosensitive drums 11, and the removed foreign matters are gathered in the waste-toner conveyor portions 88.

As depicted in FIG. 6B, the foreign matters gathered in the waste-toner conveyor portions 88 are conveyed rightward to the inside of the connecting portions 54 of the waste-toner conveyor member 51 by the first auger members 83.

As depicted in FIG. 7B, the foreign matters gathered in the connecting portions 54 fall into the conveyor tube 52 through the respective communication portions 55 from the connecting portions 54.

As depicted in FIG. 10A, the foreign matters gathered in the conveyor tube 52 are further conveyed rearward to the waste-toner storage portion 23 via the opening 59 by the second auger member 57.

The up-down direction is an example of an orthogonal direction. The front-rear direction is an example of an arrangement direction. The right-left direction is an example of an axial direction. The right inner side-plate 31 is an example of a side plate. Each of the flange members 42 is an example of a supported portion. Each of the drum couplings 45 is an example of a driving-force receiving portion. Each of the larger-diameter portions 43 is an example of a first portion. Each of the smaller-diameter portions 44 is an example of a second portion. Each of the gear portions 43A is an example of a first gear. Each of the cleaner frames 81 is an example of a support portion. Each of the cleaning blades 82 is an example of a cleaning member. Each of the first auger members 83 is an example of a first conveyor member. Each of the first auger member gears 80 is an example of a second gear. The center of curvature A1 of the front surface of each of the static eliminating members 84 is an example of a central axis of the first conveyor member. The center of rotation A2 of the first auger member 83 is an example of a rotation axis of the first conveyor member. Each of the connectors 53 is an example of a connector. The second auger member 57 is an example of a second conveyor member.

(1) According to the drum unit 9, as depicted in FIG. 6A, the second auger member 57 is disposed in the space between the right inner side-plate 31 and the right ends of the drum bodies 41.

This configuration might not require provision of a particular space for installing the second auger member 57 on purpose at a position outside one of the inner side-plates 31 that support the photosensitive drums 11, thereby restricting increase in size of the drum unit 9.

(2) According to the drum unit 9, as depicted in FIGS. 6B and 7B, at least a portion of the second auger member 57 overlaps the drum bodies 41 when projected in the right-left direction.

With this configuration, the second auger member 57 may be disposed in the space that extends between the right inner side-plate 31 and the right ends of the drum bodies 41.

Therefore, increase in size of the drum unit 9 may be further restricted.

(3) According to the drum unit 9, as depicted in FIG. 6A, the flange members 42 each have the smaller-diameter portion 44 that is smaller in size than the larger-diameter portion 43 thereof that is configured to be connected to a corresponding one of the drum bodies 41.

With this configuration, a larger space may be ensured in the up-down direction in an area in which the second auger member 57 overlaps the smaller-diameter portions 44 in the up-down direction than an area in which the second auger member 57 overlaps the larger-diameter portion 43 in the up-down direction.

Therefore, the second auger member 57 may be disposed in such a space, thereby restricting increase in size of the drum unit 9.

(4) According to the drum unit 9, as depicted in FIG. 6A, the drum couplings 45 are connected to the respective smaller-diameter portions 44 of the left flange members 42L disposed to the left of the left inner side-plate 31, and each include the coupling portion 45A that is larger in size than the smaller-diameter portion 44 of each of the left flange members 42L.

With this configuration, an appropriate size may be ensured for the coupling portions 45A of the drum couplings 45 while the size of the smaller-diameter portions 44 supported by the left inner side-plate 31 is reduced.

Therefore, the drum couplings 45 may surely receive driving force while less space is required for the inner side-plates 31 to support the photosensitive drums 11.

(5) According to the drum unit 9, the drum couplings 45 are detachably fitted to the smaller-diameter portions 44 of the left flange members 42L, respectively.

Therefore, through the removal of the drum couplings 45 from the smaller-diameter portions 44 of the left flange members 42L, respectively, the photosensitive drums 11 may be attached to and detached from the inner side-plates 31 smoothly.

(6) According to the drum unit 9, as depicted in FIG. 6A, the larger portion of the conveyor tube 52 is located at the higher position than the lower ends E of the inner side-plates 31.

Therefore, the conveyor tube 52 may be disposed while less space is required in the up-down direction.

(7) According to the drum unit 9, as depicted in FIG. 5, the waste-toner conveyor member 51 may be positioned with respect to the plurality of cleaner frames 81 in the front-rear direction and in the up-down direction using the foremost fixed portion 56.

The fixed portions 56 other than the foremost fixed portion 56 may allow a dimensional tolerance in the intervals between the plurality of fixed portions 56 with respect to the intervals between the plurality of cleaner frames 81 in the front-rear direction.

(8) According to the drum unit 9, as depicted in FIG. 6B, the right end portions of the first auger members 83 are disposed inside the connecting portions 54, respectively.

With this configuration, foreign matters removed using the cleaning blades 82 may be surely conveyed to the connecting portions 54.

(9) According to the drum unit 9, as depicted in FIGS. 5 and 6B, the seal members 61 may prevent or reduce a leakage of foreign matters from between each of the waste-toner conveyor portions 88 of the drum cleaners 32 and a corresponding one of the connecting portions 54 during conveyance of the foreign matters.

(10) According to the drum unit 9, as depicted in FIG. 8, the left flange members 42L of the plurality of photosensitive drums 11 each have the gear portion 43A. The plurality of first auger members 83 each have the first auger member gear 80 that is configured to mesh with the gear portion 43A.

Therefore, the first auger members 83 may be driven by use of driving force inputted into the photosensitive drums 11 with such a simple configuration.

(11) According to the drum unit 9, as depicted in FIG. 7B, the first auger members 83 are disposed at the respective positions shifted from the corresponding static eliminating members 84 in a direction that the first auger members 83 are spaced apart from the corresponding photosensitive drums 11 with respect to the front-rear direction, i.e., the first auger members 83 are disposed further to the rear than the corresponding static eliminating members 84.

Therefore, this configuration may enable the first auger members 83 to pass foreign matters to the second auger member 57 with avoiding the static eliminating members 84 in the direction the first auger members 83 are spaced apart from the corresponding photosensitive drums 11.

Consequently, smooth passing of foreign matters from the first auger members 83 to the second auger member 57 may be ensured.

(12) According to the drum unit 9, as depicted in FIGS. 6B and 7B, the static eliminating members 84 overlap the second auger member 57 in the up-down direction. Therefore, this configuration may enable the first auger members 83 to pass foreign matters to the second auger member 57 smoothly.

Figure 12:
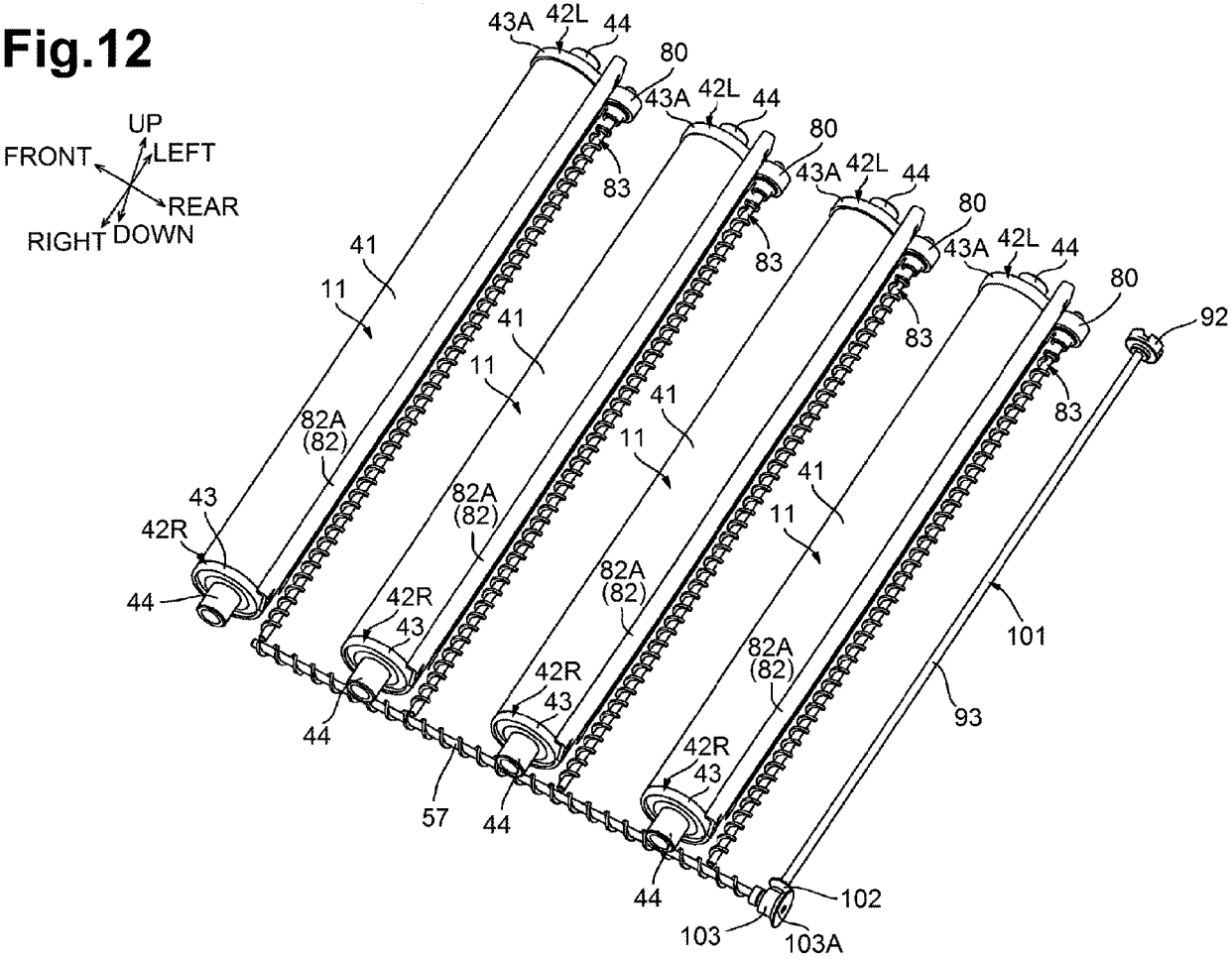
FIG. 12 is a diagram for explaining a first variation of the illustrative embodiment according to one or more aspects of the disclosure.

6. Variations (1) In the above-described illustrative embodiment, the worm 94 is disposed at the right end portion of the rotation member 91 and a helical gear is used as the second auger member gear 58 configured to mesh with the worm 94. Nevertheless, in other embodiments, for example, as depicted in FIG. 12, a first bevel gear 102 may be disposed at the right end portion of the rotation member 91 and a second bevel gear 103A for meshing with the first bevel gear 102 may be disposed at a second auger member gear 103.

(2) In the above-described illustrative embodiment, in the state where the drum unit 9 is located at the separated position, the shutter 60 is located at the position slightly shifted toward the closed position from the open position. Nevertheless, in other embodiments, for example, as depicted in FIG. 13B, a shutter 111 may be configured to be located at the closed position while the drum unit 9 is located at the separated position.

More specifically, a boss 112 having a substantially circular cylindrical shape may be disposed so as to protrude rightward from a right-rear end portion of the shutter 111, and an inclined rib 113 may be disposed at the right end portion of the printer body 2 inside the printer body 2. The inclined rib 113 may be configured to engage with the boss 112.

Figure 13A:
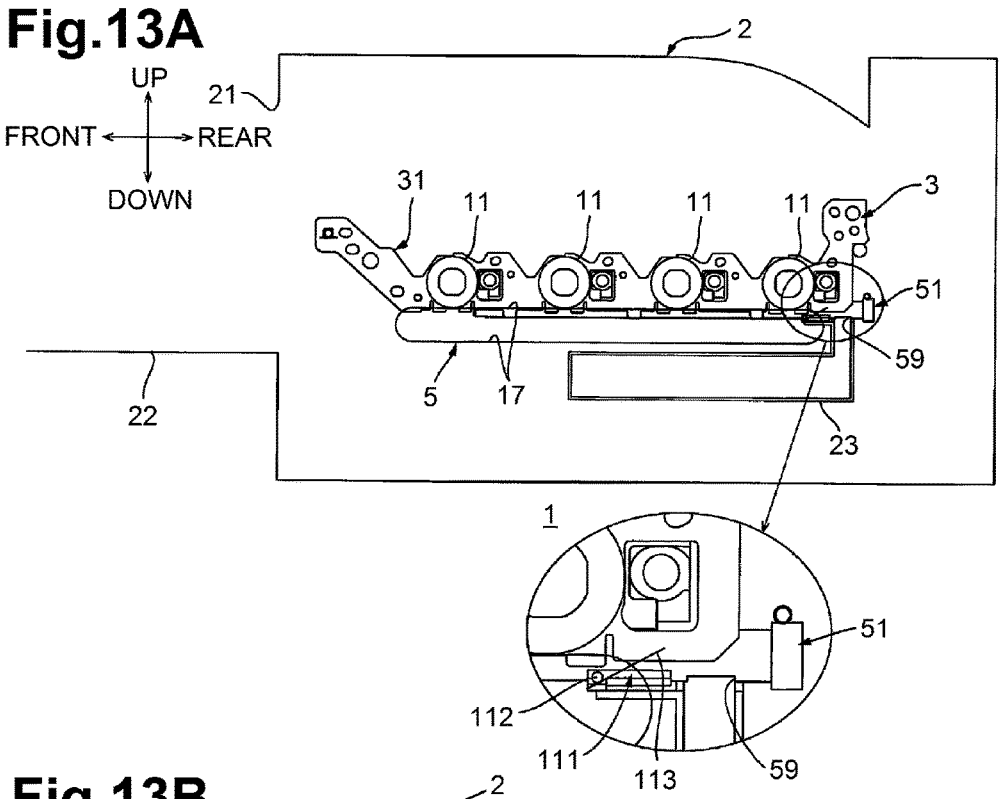
FIG. 13A is a diagram for explaining a second variation of the illustrative embodiment according to one or more aspects of the disclosure, wherein the drum unit is located at the installed position and the shutter is located at the open position.

When the drum unit 9 is located at the installed position, as depicted in FIG. 13A, the boss 112 may be in contact with a lower end portion of the inclined rib 113 to locate the shutter 111 at the open position.

Figure 13B:
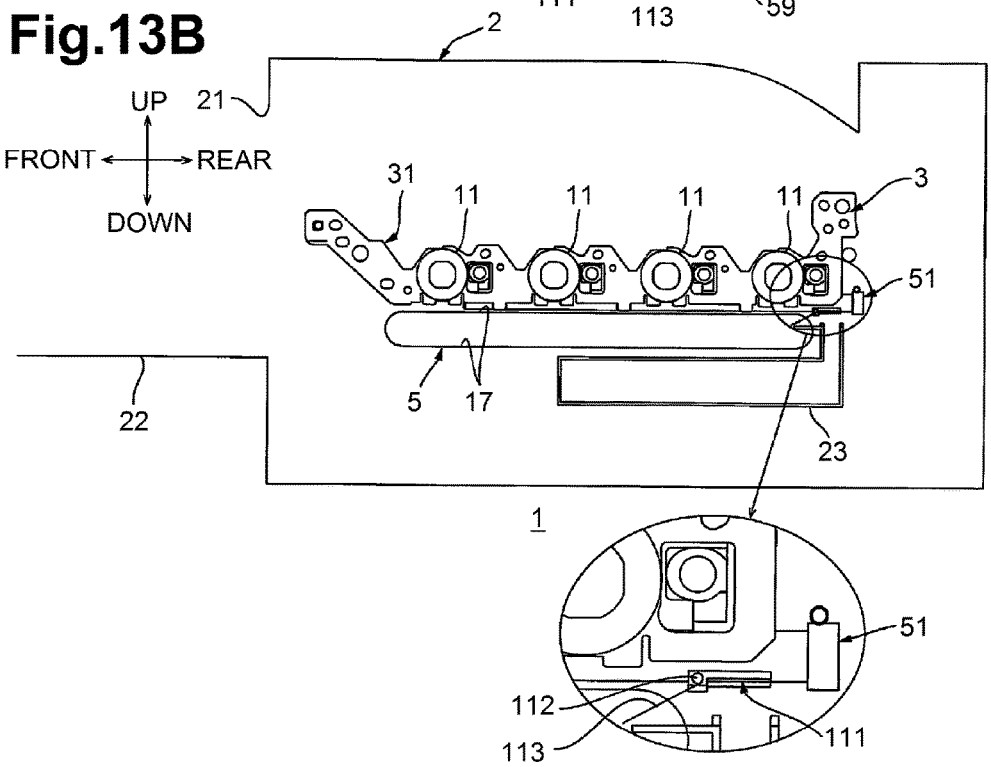
FIG. 13B is a diagram for explaining the second variation of the illustrative embodiment according to one or more aspects of the disclosure, wherein the shutter is located at the closed position.

In response to an upward movement of the drum unit 9 from the installed position to the separated position, as depicted in FIG. 13B, the shutter 111 thus moves from the open position to the closed position by urging force of the urging member (not depicted) while the boss 112 slides upward and rearward along the inclined rib 113.

Figure 14:
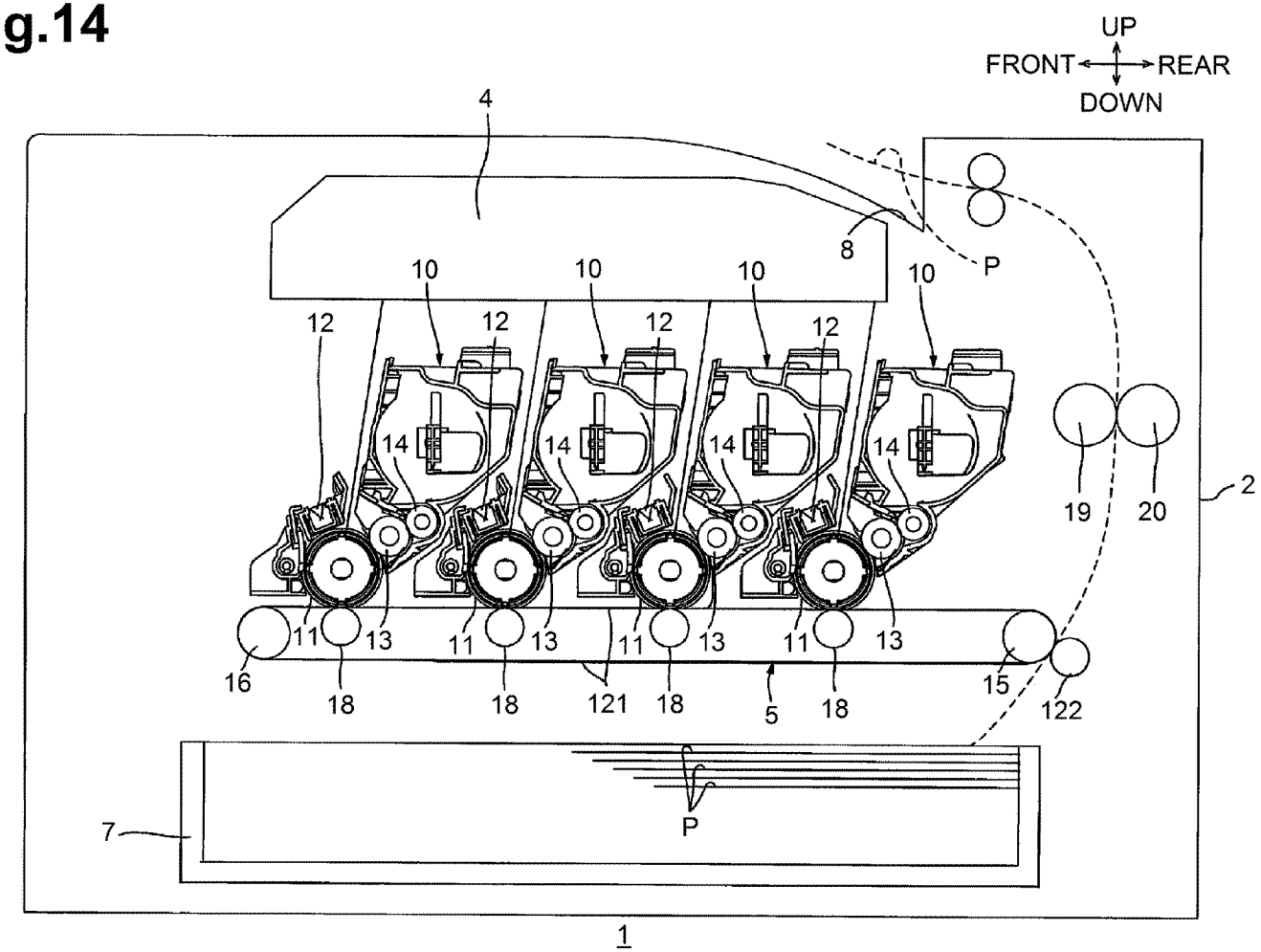
FIG. 14 is a vertical, central cross sectional view depicting an intermediate-transfer type printer embodying an image forming apparatus in a third variation of the illustrative embodiment according to one or more aspects of the disclosure.

(3) In the above-described illustrative embodiment, the image forming apparatus is implemented as a direct-tandem-type color laser printer. Nevertheless, in other embodiments, for example, as depicted in FIG. 14, the image forming apparatus may be implemented as an intermediate-transfer-type color printer 1 including an intermediate transfer belt 121 and a secondary-transfer roller 122.

In this case, in an image forming operation, the intermediate transfer belt 121 may rotate such that an upper portion of the intermediate transfer belt 121 moves toward the front.

Toner images held by the respective photosensitive drums 11 may be transferred onto an upper portion of the intermediate transfer belt 122. Then, with the rotation of the intermediate transfer belt 122, the transferred toner images may be conveyed toward and pass under the plurality of transfer rollers 18. Thereafter, the toner images may reach a position between the drive roller 15 and the secondary-transfer roller 122.

Meanwhile, a sheet P may be conveyed rearward and upward from the sheet feed tray 7 and may be then supplied to the position between the drive roller 15 and the secondary transfer roller 122 at a predetermined timing.

When the sheet P is supplied at the predetermined timing, the toner images held on the intermediate transfer belt 122 may be transferred onto the sheet P. While the sheet P passes between the heat roller 19 and the pressure roller 20, the toner images transferred on the sheet P are fixed thereon by heat. Thereafter, the sheet P may be discharged onto the sheet discharge tray 8.

(4) In the above-described illustrative embodiment, after the drum unit 9 moves to the separated position, the shutter 60 moves to the closed position in response to the movement of the drum unit 9 from the separated position to the pulled-out position. Nevertheless, in other embodiments, for example, the shutter 60 may be moved to at the closed position as the drum unit 9 is moved forward slightly from the installed position. After that, the drum unit 9 may be moved to the separated position, and then the drum unit 9 may be moved to the pulled-out position.

(5) In the above-described illustrative embodiment, the inner side-plates 31 support the smaller-diameter portions 44 of the flange members 42 of the photosensitive drums 11. Nevertheless, in other embodiments, for example, instead of the smaller-diameter portions 44, drum shafts may be disposed at the respective photosensitive drums 11 to pass through the centers of the photosensitive drums 11, respectively. In this case, the inner side-plates 31 may support the drum shafts of the photosensitive drums 11.

In the above-described illustrative embodiment, the conveyor tube 52 is disposed so as to extend along the front-rear direction. Nevertheless, in other embodiments, for example, the conveyor tube 52 may be disposed so as to extend diagonally with respect to the front-rear direction. More specifically, the conveyor tube 52 may be inclined such that the rear end portion is located at a position lower than the front end portion.

In the above-described illustrative embodiment, each of the first auger member 83 is used as an example of the first conveyor member and the second auger member 57 is used as an example of the second conveyor member. In other embodiments, for example, a helical spring member may be used as the first conveyor member and the second conveyor member.

In the above-described illustrative embodiment, the cleaning blades 82, which have a substantially plate shape extending in the right-left direction, are used as examples of the cleaning members. Nevertheless, in other embodiments, for example, a cleaning roller, which has a substantially circular cylindrical shape extending in the right-left direction, may be used as the cleaning members.

According to the above-described variations, the same effects as those obtained in the illustrative embodiment may also be obtained.

What is claimed is:

1. An image forming apparatus comprising:

a printer body including a waste-toner storage portion; and a process unit movable between a first position, at which the process unit is positioned inside the printer body, and a second position, at which the process unit is positioned outside the printer body, the process unit comprising;

a first photosensitive drum rotatable about a rotational axis, the first photosensitive drum including a first drum body having a first photosensitive layer and a first flange member extending from one end of the first drum body in an axial direction along the rotational axis of the first photosensitive drum;

a second photosensitive drum rotatable about a rotational axis, the second photosensitive drum including a second drum body having a second photosensitive layer and a second flange member extending from one end of the second drum body in the axial direction;

a first side plate supporting the first photosensitive drum and the second photosensitive drum;

a second side plate supporting the first photosensitive drum and the second photosensitive drum, the first drum body of the first photosensitive drum and the second drum body of the second photosensitive drum being disposed between the first side plate and the second side plate in the axial direction, the first side plate including an upper end and a lower end;

a first cleaning unit having a first cleaner and a first conveyor, the first cleaner being configured to remove waste toner from the first photosensitive drum, the first conveyor being configured to convey waste toner removed by the first cleaner in the axial direction;

a second cleaning unit having a second cleaner and a second conveyor, the second cleaner being configured to remove waste toner from the second photosensitive drum, the second conveyor being configured to convey waste toner removed by the second cleaner in the axial direction; and a waste-toner conveyor unit including a conveyor tube for conveying waste toner conveyed by the first conveyor and waste toner conveyed by the second conveyor toward the waste-toner storage portion, wherein the conveyor tube of the waste-toner conveyor unit is disposed between the first side plate and the first drum body, wherein the conveyor tube of the waste-toner conveyor unit is disposed below the rotational axis of the first photosensitive drum, wherein the conveyor tube of the waste-toner conveyor unit is disposed above the lower end of the first side plate, and wherein the conveyor tube of the waste-toner conveyor unit is disposed outside the printer body together with the process unit in a case that the process unit is positioned at the second position.

2. The image forming apparatus according to claim 1, wherein the first flange member has a larger-diameter portion rotatable about the rotational axis of the first photosensitive drum and a smaller-diameter portion rotatable about the rotational axis of the first photosensitive drum, the larger-diameter portion of the first flange member being fitted to the end of the first drum body in the axial direction, the first side plate supporting the smaller-diameter portion of the first flange member, a diameter of the smaller-diameter portion of the first flange member being smaller than a diameter of the larger-diameter portion of the first flange member, and wherein the conveyor tube of the waste-toner conveyor unit is disposed between the first side plate and the larger-diameter portion of the first flange member.

3. The image forming apparatus according to claim 2, wherein the conveyor tube of the waste-toner conveyor unit is disposed below the smaller-diameter portion of the first flange member.

4. The image forming apparatus according to claim 1, wherein the first flange member has a larger-diameter portion rotatable about the rotational axis of the first photosensitive drum and a smaller-diameter portion rotatable about the rotational axis of the first photosensitive drum, the larger-diameter portion of the first flange member being fitted to the end of the first drum body in the axial direction, the first side plate supporting the smaller-diameter portion of the first flange member, a diameter of the smaller-diameter portion of the first flange member being smaller than a diameter of the larger-diameter portion of the first flange member, and wherein the conveyor tube of the waste-toner conveyor unit is disposed below the smaller-diameter portion of the first flange member.

5. The image forming apparatus according to claim 1, wherein the first photosensitive drum including a third flange member extending from another end of the first drum body in the axial direction, the third flange member has a gear portion, and wherein the first photosensitive drum includes a drum coupling fitted to the third flange member of the first photosensitive drum and the drum coupling rotatable with the third flange member, the drum coupling including a coupling portion being configured to be engaged with a printer-body coupling of the printer body to rotate the drum coupling with the printer-body coupling.

6. The image forming apparatus according to claim 1, wherein the first photosensitive drum includes a third flange member extending from another end of the first drum body in an axial direction, the third flange member having a gear portion, and wherein the first conveyor is an auger member, the first conveyor includes a gear supported at an end of the first conveyor, the gear of the first conveyer being meshed with the gear portion of the third flange member.

7. The image forming apparatus according to claim 1, wherein the conveyor tube has an opening and includes a shutter, the shutter being movable between a closed position, at which the shutter closes the opening, and an open position, at which the shutter exposes the opening, the shutter being positioned at the open position in a state where the process unit is positioned at the first position, the shutter being positioned at the second position in a state where the process unit is positioned at the second position, the opening of the conveyor tube communicating with the waste-toner storage portion of the printer body in a state where the process unit is positioned at the first position and the shutter is positioned at the open position.

8. The image forming apparatus according to claim 1, wherein the conveyor tube is disposed below the first conveyor.

9. The image forming apparatus according to claim 8, wherein the first conveyor is an auger member.

10. The image forming apparatus according to claim 1, the waste-toner conveyor unit including an auger member disposed inside the conveyor tube, the auger member being rotatable about a rotational axis to convey waste toner conveyed by the first conveyor and waste toner conveyed by the second conveyor toward the waste-toner storage portion.

11. An image forming apparatus comprising:

a printer body including a waste-toner storage portion, the waste-toner storage portion having a substantially box shape; and a process unit movable between a first position, at which the process unit is positioned inside the printer body, and a second position, at which the process unit is positioned outside the printer body, the process unit comprising;

a first photosensitive drum including a first drum body and a first flange member fitted to one end of the first drum body, the first drum body including a metal tube having a substantially cylindrical shape, a portion of the first flange member being inside the first drum body;

a second photosensitive drum including a second drum body and a second flange member fitted to one end of the second drum body, the second drum body including a metal tube having a substantially cylindrical shape, a portion of the second flange member being inside the second drum body;

a first side plate supporting the first photosensitive drum and the second photosensitive drum;

a second side plate supporting the first photosensitive drum and the second photosensitive drum, the first drum body of the first photosensitive drum and the second drum body of the second photosensitive drum being disposed between the first side plate and the second side plate, the first side plate having an upper end and a lower end;

a first cleaning blade for removing waste toner from the first photosensitive drum;

a first auger for conveying waste toner removed by the first cleaning blade;

a second cleaning blade for removing waste toner from the second photosensitive drum;

a second auger for conveying waste toner removed by the second cleaning blade; and a conveyor tube for conveying waste toner conveyed by the first auger and waste toner conveyed by the second auger toward the waste-toner storage portion, the conveyor tube being disposed between the first side plate and the first drum body, the conveyor tube being disposed below the first auger, and the conveyor tube being disposed above the lower end of the first side plate.

12. The image forming apparatus according to claim 11, wherein the first flange member has an inner end portion and an outer end portion, the inner end portion having a substantially cylindrical shape and fitted to the end of the first drum body, the outer end portion having a substantially cylindrical shape and protruding outward from the inner end portion of the first flange member, the first side plate supporting the outer end portion, a diameter of the outer end portion of the first flange member being smaller than a diameter of the inner end portion of the first flange member, and wherein the conveyor tube is disposed between the first side plate and the inner end portion of the first flange member.

13. The image forming apparatus according to claim 12, wherein the conveyor tube is disposed below the outer end portion of the first flange member.

14. The image forming apparatus according to claim 11, wherein the first flange member has an inner end portion and an outer end portion, the inner end portion having a substantially cylindrical shape and fitted to the end of the first drum body, the outer end portion having a substantially cylindrical shape and protruding outward from the inner end portion of the first flange member, the first side plate supporting the outer end portion, a diameter of the outer end portion of the first flange member being smaller than a diameter of the inner end portion of the first flange member, and wherein the conveyor tube is disposed below the outer end portion of the first flange member.

15. The image forming apparatus according to claim 11, further including a third auger disposed inside the conveyor tube to convey waste toner conveyed by the first auger and waste toner conveyed by the second auger toward the waste-toner storage portion.

16. A process unit movable between a first position, at which the process unit is positioned inside a printer body, and a second position, at which the process unit is positioned outside the printer body, the process unit comprising:

a first photosensitive drum including a first drum body and a first flange member fitted to one end of the first drum body, the first drum body including a metal tube having a substantially cylindrical shape, a portion of the first flange member being inside the first drum body;

a second photosensitive drum including a second drum body and a second flange member fitted to one end of the second drum body, the second drum body including a metal tube having a substantially cylindrical shape, a portion of the second flange member being inside the second drum body;

a first side plate supporting the first photosensitive drum and the second photosensitive drum;

a second side plate supporting the first photosensitive drum and the second photosensitive drum, the first drum body of the first photosensitive drum and the second drum body of the second photosensitive drum being disposed between the first side plate and the second side plate, the first side plate having an upper end and a lower end;

a first cleaning blade for removing waste toner from the first photosensitive drum;

a first auger for conveying waste toner removed by the first cleaning blade;

a second cleaning blade for removing waste toner from the second photosensitive drum;

a second auger for conveying waste toner removed by the second cleaning blade; and a waste-toner conveyor unit including a conveyor tube for conveying waste toner conveyed by the first auger and waste toner conveyed by the second auger, the conveyor tube being disposed between the first side plate and the first drum body, the conveyor tube being disposed below the first auger, and the conveyor tube being disposed above the lower end of the first side plate.

17. The process unit according to claim 16, wherein the first flange member has an inner end portion and an outer end portion, the inner end portion having a substantially cylindrical shape and fitted to the end of the first drum body, the outer end portion having a substantially cylindrical shape and protruding outward from the inner end portion of the first flange member, the first side plate supporting the outer end portion, a diameter of the outer end portion of the first flange member being smaller than a diameter of the inner end portion of the first flange member, and wherein the conveyor tube of the waste-toner conveyor unit is disposed between the first side plate and the inner end portion of the first flange member.

18. The process unit according to claim 17, wherein the conveyor tube of the waste-toner conveyor unit is disposed below the outer end portion of the first flange member.

19. The process unit according to claim 16, wherein the first flange member has an inner end portion and an outer end portion, the inner end portion having a substantially cylindrical shape and fitted to the end of the first drum body, the outer end portion having a substantially cylindrical shape and protruding outward from the inner end portion of the first flange member, the first side plate supporting the outer end portion, a diameter of the outer end portion of the first flange member being smaller than a diameter of the inner end portion of the first flange member, and wherein the conveyor tube of the waste-toner conveyor unit is disposed below the outer end portion of the first flange member.

20. The process unit according to claim 16, the waste-toner conveyor unit including a third auger disposed inside the conveyor tube to convey waste toner conveyed by the first auger and waste toner conveyed by the second auger toward a waste-toner storage portion.

* * * * *